US007712864B2

(12) United States Patent
Shindo et al.

(10) Patent No.: US 7,712,864 B2
(45) Date of Patent: May 11, 2010

(54) APPARATUS AND METHOD FOR MAINTAINING RECORDING HEAD

(75) Inventors: Tatsuya Shindo, Nagoya (JP); Kiyoharu Hayakawa, Nagoya (JP); Katsunori Nishida, Aichi-gun (JP); Hikaru Kaga, Aisai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1056 days.

(21) Appl. No.: 11/258,178

(22) Filed: Oct. 26, 2005

(65) Prior Publication Data

US 2006/0092213 A1 May 4, 2006

(30) Foreign Application Priority Data

Oct. 28, 2004 (JP) ..... 2004-313327

(51) Int. Cl.
*B41J 2/165* (2006.01)
*B41J 2/17* (2006.01)
*B41J 2/175* (2006.01)

(52) U.S. Cl. ..... 347/29; 347/84; 347/85

(58) Field of Classification Search ..... 347/29, 347/30, 31, 32, 84, 85, 86
See application file for complete search history.

(56) References Cited

U.S. PATENT DOCUMENTS 4,707,714 A 11/1987 Rosenthal et al.
5,018,884 A * 5/1991 Hirano et al. ..... 347/30
5,424,768 A * 6/1995 Dudek et al. ..... 347/29
5,621,441 A * 4/1997 Waschhauser et al. ..... 347/33
5,805,181 A * 9/1998 Tanaka et al. ..... 347/29
6,039,432 A * 3/2000 Fukuoka ..... 347/32
6,068,364 A * 5/2000 Kusumi et al. ..... 347/29
6,074,037 A * 6/2000 Nakahara et al. ..... 347/29
6,081,282 A * 6/2000 Saijo ..... 347/29
6,102,533 A * 8/2000 Nozawa et al. ..... 347/86

(Continued)

FOREIGN PATENT DOCUMENTS

EP 0 726 153 8/1996

(Continued)

*Primary Examiner*—Manish S Shah
*Assistant Examiner*—Leonard S Liang
(74) *Attorney, Agent, or Firm*—Banner & Witcoff, Ltd.

(57) ABSTRACT

An apparatus for maintaining a recording head which has a nozzle opening in a nozzle-defining surface thereof, and ejects, from the nozzle, a droplet of an ink toward a recording medium, in a state in which the recording head is separate from a remaining portion of a recording device. The apparatus includes a cover member which is adapted to air-tightly contact the recording head to cover the nozzle-defining surface of the recording head such that a space is formed between the cover member and the nozzle-defining surface. The apparatus further includes a selectively communicating device which can selectively take (a) a first state thereof in which the selectively communicating device allows the space to communicate with an atmosphere so that substantially no difference is produced between an air pressure in the space and an atmospheric pressure, when the cover member is air-tightly contacted with the recording head; and (b) a second state thereof in which the selectively communicating device shuts off the communication between the space and the atmosphere, and thereby air-tightly closes the space, after the cover member is air-tightly contacted with the recording head.

26 Claims, 14 Drawing Sheets

U.S. PATENT DOCUMENTS

| | | | | |
|---|---|---|---|---|
| 6,179,404 | B1 * | 1/2001 | Kawarama et al. | 347/31 |
| 6,247,598 | B1 * | 6/2001 | Hosaka et al. | 206/723 |
| 6,264,315 | B1 * | 7/2001 | Nozawa et al. | 347/86 |
| 6,390,593 | B1 * | 5/2002 | DeRoos et al. | 347/31 |
| 6,412,905 | B1 * | 7/2002 | Lin | 347/29 |
| 6,561,637 | B2 * | 5/2003 | Hino | 347/92 |
| 7,021,741 | B2 * | 4/2006 | Aldrich et al. | 347/29 |
| 7,033,006 | B2 * | 4/2006 | Ebisawa et al. | 347/85 |
| 7,101,018 | B2 * | 9/2006 | Yun | 347/29 |
| 7,232,205 | B2 * | 6/2007 | Nakajima | 347/29 |
| 7,311,375 | B2 * | 12/2007 | Suzuki et al. | 347/29 |
| 7,338,146 | B2 * | 3/2008 | Morikoshi | 347/29 |
| 2002/0075348 | A1 * | 6/2002 | Shindo et al. | 347/29 |
| 2002/0130917 | A1 * | 9/2002 | Mitsui et al. | 347/29 |
| 2003/0189616 | A1 * | 10/2003 | Yamada | 347/29 |
| 2006/0082621 | A1 * | 4/2006 | Tsukada et al. | 347/85 |

FOREIGN PATENT DOCUMENTS

| | | | |
|---|---|---|---|
| JP | 61297150 | A | 12/1986 |
| JP | 09-254401 | | 9/1997 |
| JP | 2002-210990 | | 7/2002 |
| JP | 3324629 | B2 | 9/2002 |
| JP | 2004-160969 | | 6/2004 |

* cited by examiner

APPARATUS AND METHOD FOR MAINTAINING RECORDING HEAD

The present application is based on Japanese Patent Application No. 2004-313327 filed on Oct. 28, 2004, the contents of which are incorporated herein by reference.

BACKGROUND OF THE INVENTION

1. Field of the Invention

The present invention relates to an apparatus and a method for maintaining a recording head of a recording device that ejects, from a nozzle of the head, a droplet of ink toward a recording medium and thereby records an image on the medium, such that the recording head is separate from a remaining portion of the recording device.

2. Discussion of Related Art

When a recording head is not used, or before the recording head is attached to a recording device after the head is manufactured, the recording head may be maintained separate from the recording device. For instance, the recording head can be charged with ink or a suitable liquid. Drying or leakage of the ink or the liquid is prevented by air-tightly sealing, with a sealing member (e.g., a cap) formed of an elastic material such as rubber, a nozzle-defining surface of the recording head that defines one or more ink ejection nozzles, as taught by Japanese Patent No. 3,324,629 or its corresponding U.S. Pat. No. 5,805,181A.

More specifically described, the above-indicated document teaches selectively using a monochromatic-image recording head or a full-color-image recording head, mounting the recording head selected, on a carriage, and maintaining the recording head not selected, in a state in which the recording head is charged with one or more sorts of ink. Meanwhile, after a recording head is manufactured, the recording head may be subjected to an ejection test, and the head that has passed the test may be maintained in a state in which the head is charged with one or more sorts of ink, or a suitable liquid, before the head is attached to a remaining portion of a recording device.

A recording head cannot normally eject a droplet of ink unless a meniscus of the ink is normally formed, owing to its surface tension, in the vicinity of an open end of a nozzle. Thus, in the state in which the recording head is maintained, it is required that the meniscus of the ink be formed at the normal position and that the nozzle-defining surface of the recording head be air-tightly sealed.

SUMMARY OF TH INVENTION

However, when the nozzle-defining surface of the recording head is covered with a sealing member, the sealing member may be elastically deformed so that a space formed between the nozzle-defining surface and the sealing member may be compressed and accordingly an air pressure in the space may be increased, and accordingly the meniscus of the ink in the nozzle may be broken.

The above-indicated document proposes a sealing method in which the above-described air-tight space is communicated with the atmosphere via a flow-resisting passage. However, since the flow-resisting passage has a considerably great resistance for the purpose of preventing drying of the ink, the passage cannot follow the change of volume of the space when the sealing member is attached to the nozzle-defining surface. Thus, the meniscus of the ink may be subjected to a high air pressure, and accordingly it may be broken. In addition, since the space defined by the sealing member is always communicated with the atmosphere, the drying of the ink cannot be effectively prevented.

It is therefore an object of the present invention to solve at least one of the above-indicated problems. It is another object of the present invention to provide a recording-head maintaining apparatus and a recording-head maintaining method each of which can maintain a nozzle in an air-tight state and thereby prevent drying of an ink or a liquid in the nozzle, without breaking a meniscus of the ink.

The above objects may be achieved according to the present invention. According to a first aspect of the present invention, there is provided an apparatus for maintaining a recording head which has a nozzle opening in a nozzle-defining surface thereof, and ejects, from the nozzle, a droplet of an ink toward a recording medium, in a state in which the recording head is separate from a remaining portion of a recording device. The apparatus comprises a cover member which is adapted to air-tightly contact the recording head to cover the nozzle-defining surface of the recording head such that a space is formed between the cover member and nozzle-defining surface. The apparatus further comprises a selectively communicating means which can selectively take (a) a first state thereof in which the selectively communicating means allows the space to communicate with an atmosphere so that substantially no difference is produced between an air pressure in the space and an atmospheric pressure, when the cover member is air-tightly contacted with the recording head; and (b) a second state thereof in which the selectively communicating means shuts off a communication between the space and the atmosphere, and thereby air-tightly closes the space, after the cover member is air-tightly contacted with the recording head.

The present recording-head maintaining apparatus includes the selectively communicating means which allows the space formed between the cover member and the nozzle-defining surface when the cover member covers the nozzle-defining surface, to communicate with the atmosphere. Therefore, when the cover member covers the nozzle-defining surface, a certain amount of air is discharged from the space into the atmosphere. Thus, the air pressure in the space can be prevented from being excessively increased, and accordingly a meniscus of the ink present in the nozzle can be reliably prevented from being broken.

In addition, the selectively communicating means air-tightly closes the communication between the space and the atmosphere and thereby shuts off the space from the atmosphere. Thus, the nozzle can be kept in the air-tight state and accordingly drying of the ink (or a different liquid) present in the nozzle can be effectively prevented.

According to a second aspect of the present invention, there is provided a method of maintaining a recording head which has a nozzle opening in a nozzle-defining surface thereof, and ejects, from the nozzle, a droplet of an ink toward a recording medium, in a state in which the recording head is separate from a remaining portion of a recording device and a cover member covers the nozzle-defining surface such that a space is formed between the cover member and the nozzle-defining surface. The method comprises keeping, when the cover member is air-tightly contacted with the recording head, a communication between the space and an atmosphere so that substantially no difference is produced between an air pressure in the space and an atmospheric pressure. The method further comprises shutting off, after the cover member is air-tightly contacted with the recording head, the communication between the space and the atmosphere, so that the space is air-tightly closed during a time period in which the cover member is air-tightly contacted with the recording head.

In the present recording-head maintaining method, the space formed between the cover member and the nozzle-defining surface is communicated with the atmosphere through the one or more through-holes, before the cover member is air-tightly contacted with the recording head. When the cover member covers the nozzle-defining surface, a certain amount of air is discharged from the space into the atmosphere through the through-hole or through-holes. Thus, the air pressure in the space can be prevented from being excessively increased, and accordingly a meniscus of the ink present in the nozzle can be reliably prevented from being broken.

In addition, after the cover member is air-tightly contacted with the recording head, the communication between the space and the atmosphere is shut off to keep the nozzle in the air-tight state. Thus, drying of the ink (or a different liquid) present in the nozzle can be effectively prevented.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

First Embodiment

Hereinafter, there will be described a first embodiment of the present invention by reference to FIGS. 1 through 3, 4A, 4B, 4C, 5A, and 5B.

Construction of Inkjet Printer 1

Figure 1:
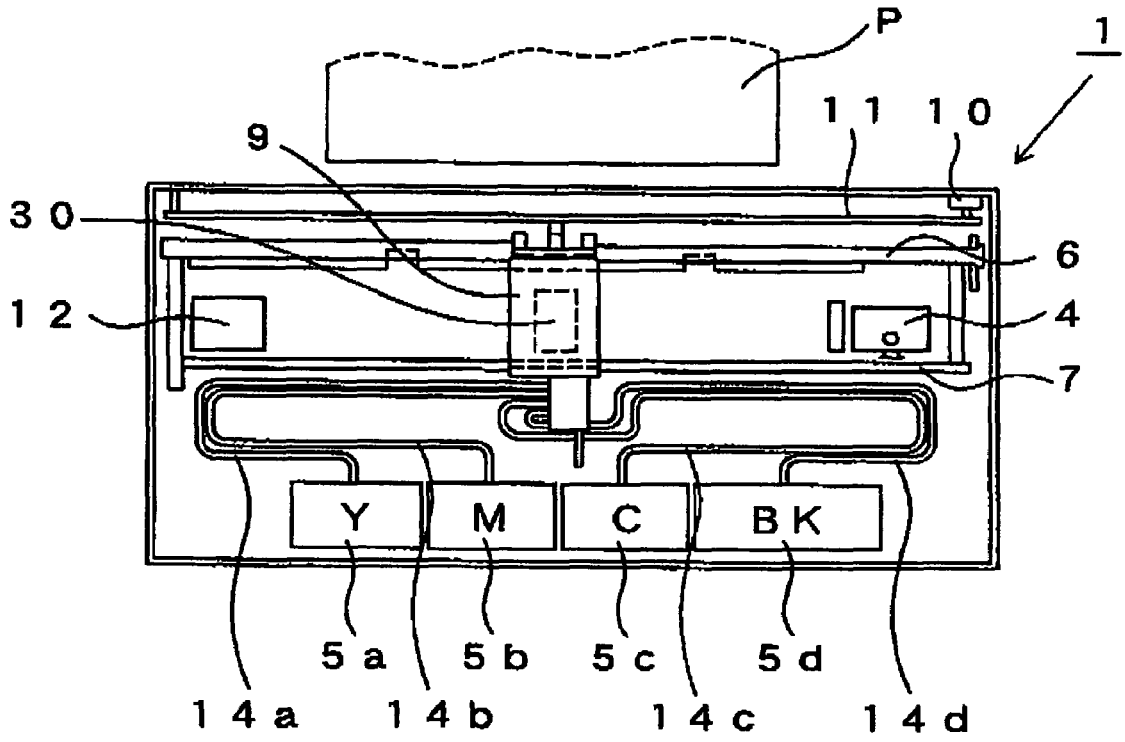
FIG. 1 is a plan view of an inkjet recording device including a recording head that can be maintained by a recording-head maintaining apparatus as a first embodiment of the present invention.

FIG. 1 is a plan view showing a construction of an inkjet recording device, i.e., an inkjet printer 1 including a recording head, i.e., an inkjet head 30 that may be maintained by a recording-head maintaining apparatus 100 (FIGS. 4A and 5A) to which the present invention is applied.

In an inner space of the inkjet printer 1, two guide bars 6, 7 are provided, and a head holder 9 functioning as a carriage is supported by the two guide bars 6, 7. The head holder 9 holds the inkjet head 30 that ejects droplets of inks toward a recording sheet, P, as a sort of recording medium and records an image on the recording sheet P. The head holder 9 is secured to an endless belt 11 that is circulated by an electric motor 10 and, when the motor 10 is driven or operated, the head holder 9 is moved on the guide bars 6, 7. A known belt-like timing indicator, not shown, is provided along the guide bar 7. The timing indicator has a number of timing marks that are used to detect a current position of the head holder 9.

Figure 2:
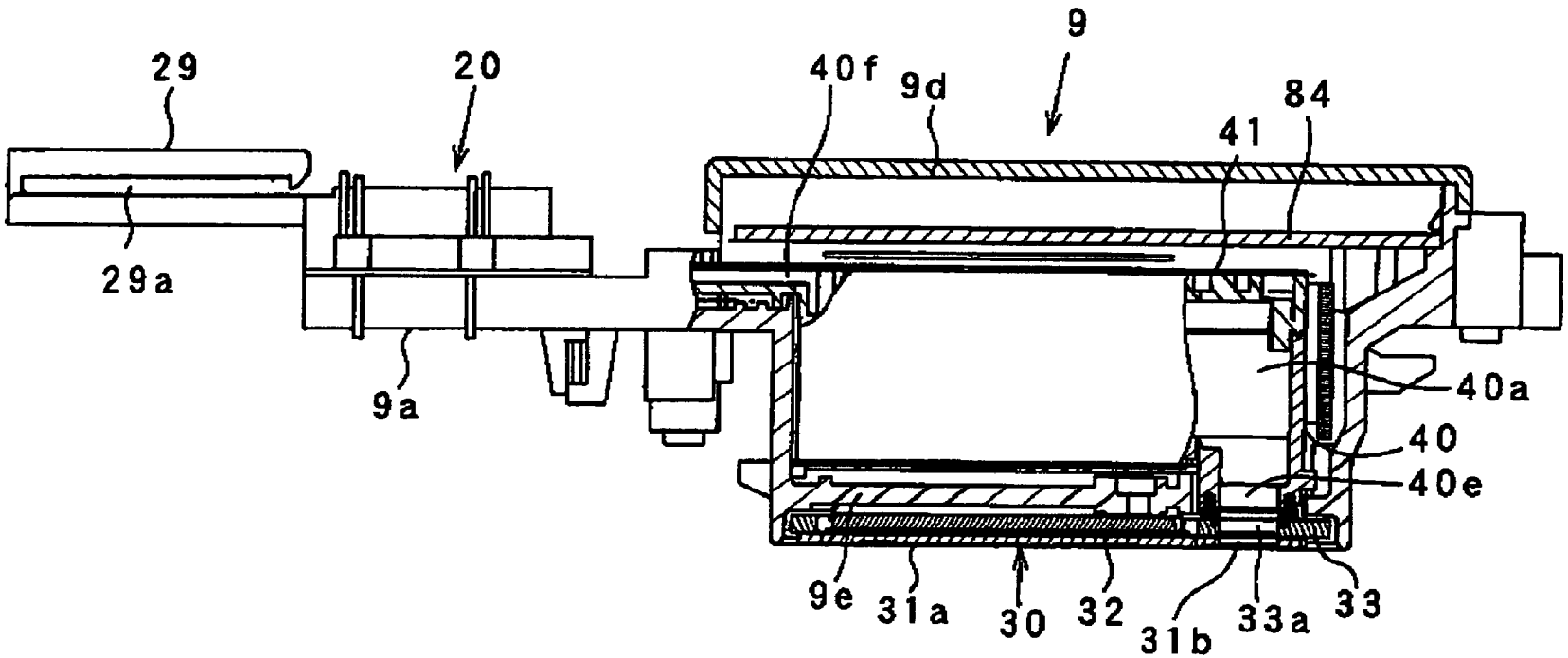
FIG. 2 is a longitudinal cross-section view of the recording head and a head holder holding the recording head.

In addition, on a stationary member, not shown, provided in the inner space of the inkjet printer 1, there are provided four ink tanks 5, i.e., an ink tank 5*a* that stores a yellow ink (Y), an ink tank 5*b* that stores a magenta ink (M), an ink tank 5*c* that stores a cyan ink (C), and an ink tank 5*d* that stores a black ink (BK). The four ink tanks 5*a*, 5*b*, 5*c*, 5*d* are connected via respective flexible ink supply tubes 14*a*, 14*b*, 14*c*, 14*d* to a tube joint 20 (FIG. 2).

In the vicinity of one of opposite ends of a movement range in which the head holder 9 can be moved, there is provided a flushing portion 12; and in the vicinity of the other end of the movement range of the head holder 9, there is provided a maintenance portion 4. The inkjet head 30 can be operated to eject bad inks containing air bubbles, toward the flushing portion 12, and thereby keep its own good ink-ejecting performance. The maintenance portion 4 can be operated to suck the bad inks from the inkjet head 30 and wipe a "nozzle" surface (i.e., a nozzle-defining surface) 31*a* (FIG. 2) of the head 30, and thereby keep the good ink-ejecting performance of the head 30.

Construction of Head Holder 9

Next, there will be described a construction of the head holder 9 that holds the inkjet head 30, by reference to FIGS. 2 and 3. In the following description, it is assumed that a surface of the head holder 9 from which droplets of inks are ejected will be referred to as the "lower" surface of the holder 9. The opposite surface of the holder 9 will be referred to as the "upper" surface of the holder 9. A direction in which the droplets of inks are ejected from the holder 9 will be referred to as the "downward" direction, and an opposite direction will be referred to as the "upward" direction. In addition, it is assumed that a direction toward a left-hand end of FIG. 1 will be referred to as the "leftward" direction. The direction opposite "leftward"will be referred to as the"rightward" direction, a direction toward a lower end of FIG. 1 will be referred to as the "frontward" direction, and a direction opposite to the frontward direction will be referred to as the"rearward" direction.

In a state in which the tube joint 20 is removed from the buffer tank 40, that is, in a recording-head maintaining state, described later, a protector member 21 (FIG. 4A) is detachably attached to the buffer tank 40 so as to close the four connection ports 40*f* of the buffer tank 40.

As shown in FIG. 2, the head holder 9 has a box-like shape, and the inkjet head 30 is held by a bottom wall 9*e* of the holder 9.

Figure 3:
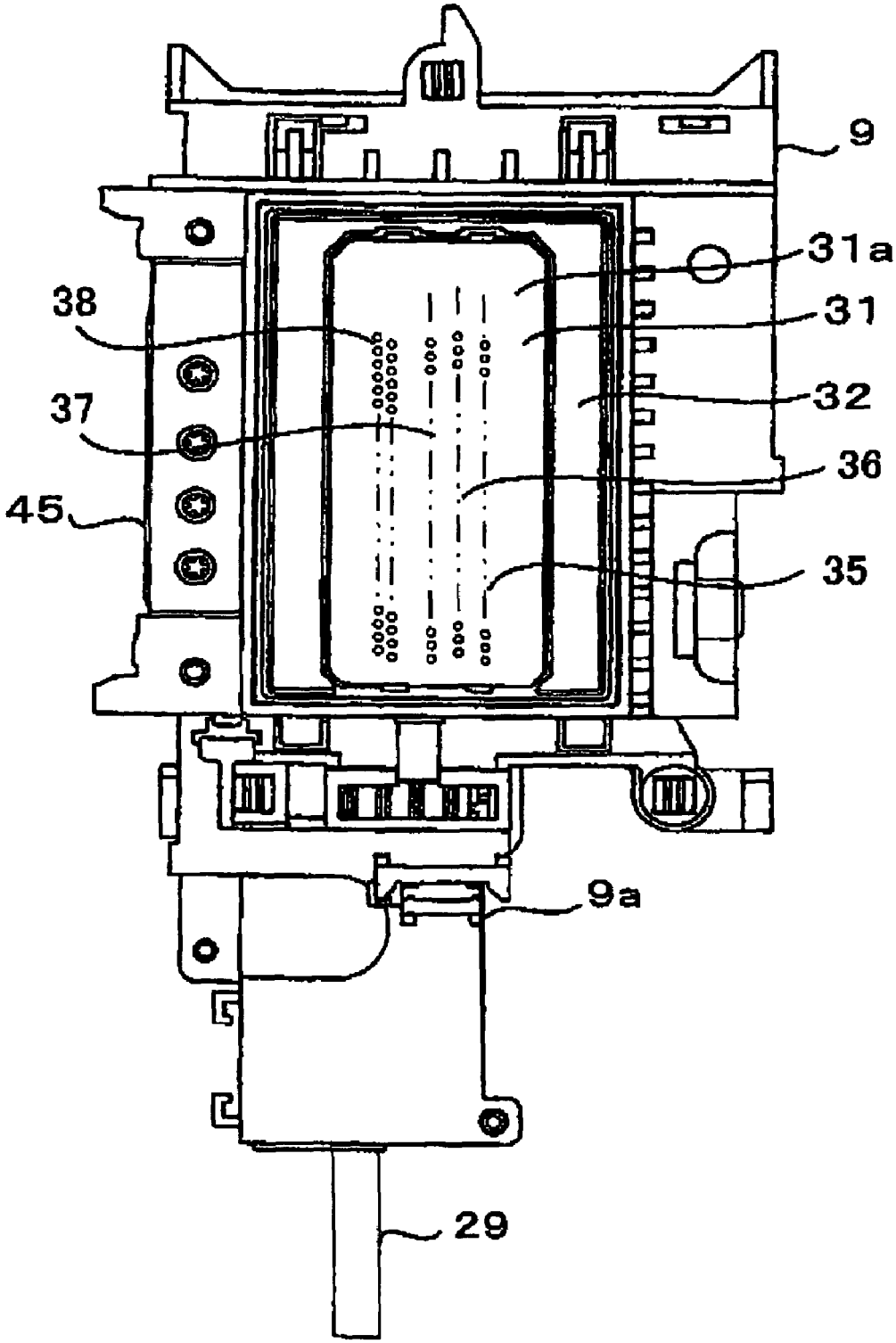
FIG. 3 is a bottom view of the head holder and the recording head held by the head holder.

As shown in FIGS. 2 and 3, the inkjet head 30 includes a cavity portion 31 having a plurality of ink flow channels, not shown, and a piezoelectric actuator 32 that applies an ejection pressure to ink present in an arbitrary one of the ink flow channels and is stacked on the cavity portion 31. The cavity portion 31 has, in the nozzle surface 31*a* as the lower surface thereof, four arrays of nozzles, i.e., an array of nozzles 35 corresponding to the yellow ink, an array of nozzles 36 corresponding to the magenta ink, an array of nozzles 37 corresponding to the cyan ink, and two arrays of nozzles 38 corresponding to the black ink. In addition, the cavity portion 31 has, in the upper surface thereof, four ink inlet ports 31*b* corresponding to the four color inks, respectively.

As shown in FIG. 2, a reinforcing frame 33 is fixed, by adhesion, to an upper surface of the inkjet head 30. The reinforcing frame 33 has four ink flow holes 33*a* corresponding to the four ink inlet ports 31*b*, respectively. A unit consisting the inkjet head 30 and the reinforcing frame 33 is provided along the lower surface of the bottom wall 9*e*, and is fixed, with an adhesive, to the bottom wall 9*e*.

The head holder 9 has, in a space located above the bottom wall 9*e* thereof, i.e., above the inkjet head 30 that faces the recording sheet P in the downward direction, a buffer tank 40 that has four ink delivering portions 40*a* that correspond to the four color inks, respectively, and are separated from each other by partition walls, not shown. The four ink delivering portions 40*a* have, in a lower surface of the buffer tank 40, respective ink supply ports 40*e* that communicate with the four ink inlet ports 31*b* via the respective ink flow holes 33*a*.

Respective upper open ends of the four ink delivering portions 40*a* are closed by a flexible membrane member 41. More specifically described, the membrane member 41 is formed of a resin-based film, and is fixed, by adhesion or supersonic welding, to respective upper ends of the partition walls that separate the four ink delivering portions 40*a* from each other, and an upper end of an outer wall of the buffer tank 40. As known in the art, a predetermined amount of air is accumulated in an upper end portion of each of the four ink delivering portions 40*a*. The predetermined amount of air cooperates with the flexible membrane 41 to absorb changes of pressure of a corresponding one of the four color inks that are caused when the inkjet head 30 is moved with the head holder 9 as the movable carriage. An excessive amount of air over the predetermined amount of air accumulated in the upper end portion of each ink delivering portion 40*a* is discharged into an outside space by an air discharging device 45 (FIG. 3) that is provided on a side surface of the buffer tank 40.

A front end portion of the head holder 9 includes, as an integral portion thereof an arm portion 9*a* that extends horizontally in the frontward direction, and a front end portion of the buffer tank 40 includes an extension portion that extends parallel to the arm portion 9*a* such that the extension portion is superposed on the arm portion 9*a*. The tube joint 20 is connected to the extension portion of the buffer tank 40.

The four flexible tubes 14*a* through 14*d* (FIG. 1) that are connected, at respective one ends thereof, to the four ink tanks 5*a* through 5*d* are connected, at the respective other ends thereof, to the tube joint 20. The tube joint 20 is detachably attached to the extension portion of the buffer tank 40, and has four communication passages, not shown, that communicate with the four tubes 14*a* through 14*d*, respectively. The buffer tank 40 has four connection ports 40*f* that communicate with the four ink delivering portions 40*a* and open in an upper surface of the extension portion. The four communication passages of the tube joint 20 communicate with the four connection ports 40*f* of the buffer tank 40, respectively, so that the four ink tanks 5*a* through 5*d* can supply the four color inks to the four ink delivering portions 40*a*, respectively.

Figure 4A:
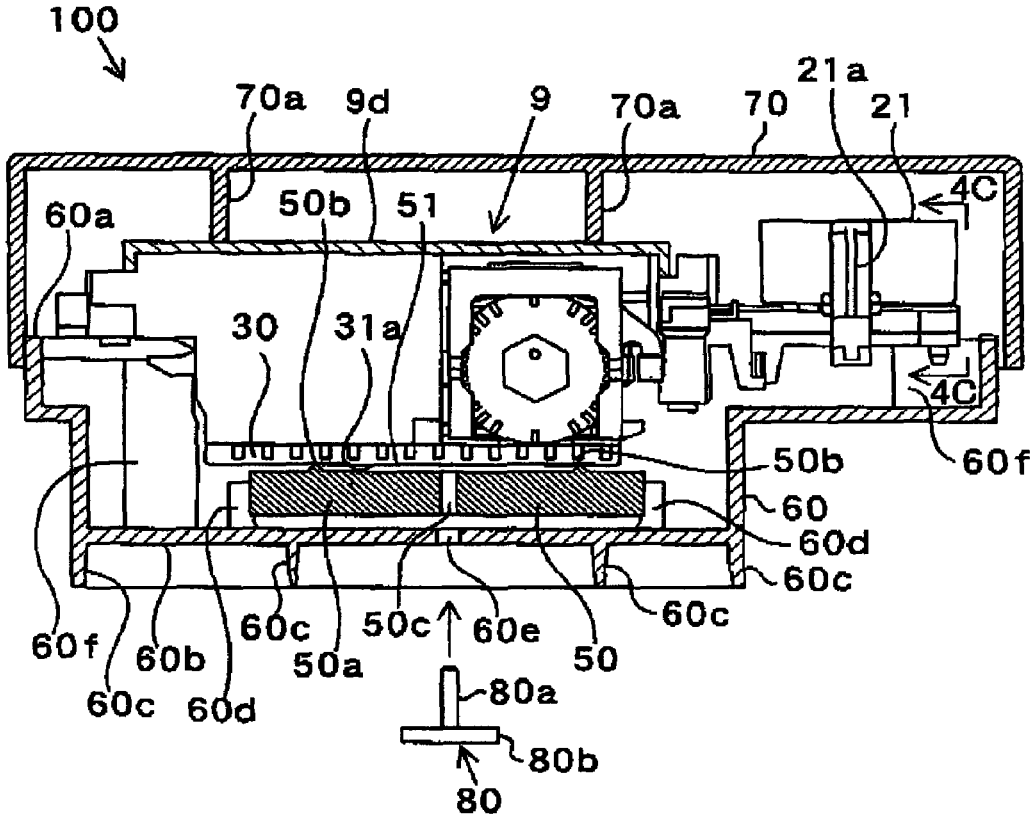
FIG. 4A is a longitudinal cross-section view of the recording-head maintaining apparatus in a state thereof before a "nozzle" surface 31*a* of the recording head is sealed.
Figure 4B:
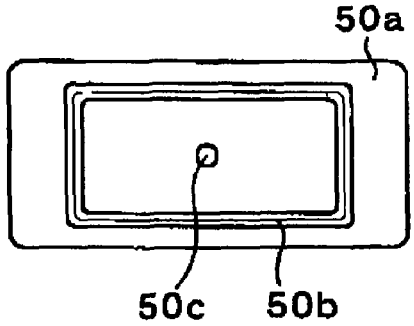
FIG. 4B is a plan view of a sealing member of the recording-head maintaining apparatus.

In a state in which the tube joint 20 is removed from the buffer tank 40, that is, in a recording-head maintaining state, described later, a protector member 21 FIG. 4A) is detachably attached to the buffer tank 40 so as to close the four connection ports 40*f* of the same 40.

The tube joint 20 includes, as a front end portion thereof, a holding projection 29 having a slit 29*a* through which a flexible flat cable, not shown, is inserted. Thus, the holding projection 29 supports the flat cable. The flat cable electrically connects an electric-circuit substrate 84, described below, to a control device, not shown, that is provided on a stationary member provided in the inner space of the inkjet printer 1.

The circuit substrate 84 is a rigid member, and is provided on an upper open end of the head holder 9 such that the substrate 84 is opposite to the inkjet head 30 with respect to the buffer tank 40. More specifically described, the circuit substrate 84 is detachably attached to the holder 9 such that the substrate 84 is supported by the respective upper ends of the walls of the head holder 9.

A cover member 9*d* is provided over the circuit substrate 84. Since the cover member 9*d* has a box-like shape opening in the downward direction, the cover member 9*d* can externally cover the upper open end of the head holder 9.

Construction of Head Maintaining Apparatus 100

Figure 4C:
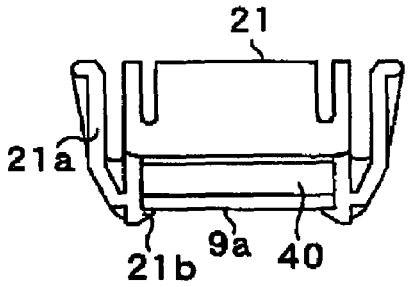
FIG. 4C is a side elevation view of a protector member of the recording-head maintaining apparatus, as seen along C-C in FIG. 4A.
Figure 5A:
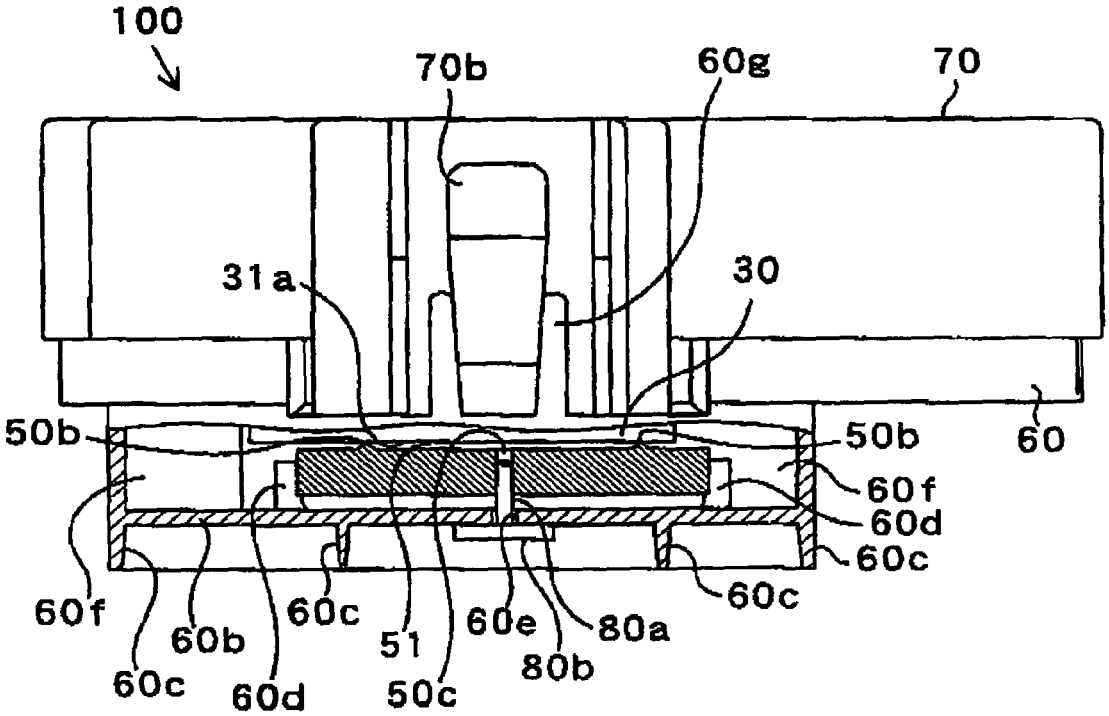
FIG. 5A is a partly cross-sectioned, side elevation view of the recording-head maintaining apparatus in a state thereof after the nozzle surface is sealed.
Figure 5B:
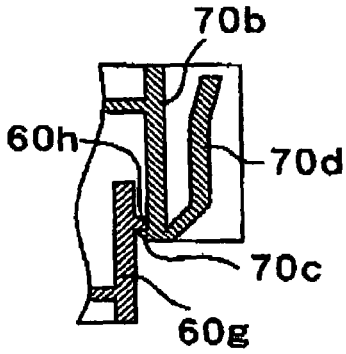
FIG. 5B is a longitudinal cross-section view of respective engaging portions of an upper case and a lower case of the recording-head maintaining apparatus.

Next, there will be described a construction of the recording-head maintaining apparatus 100 that maintains the inkjet head 30, by reference to FIGS. 4A, 4B, 4C, 5A, and 5B. FIG. 4A shows the head maintaining apparatus 100 in a state thereof before the nozzle surface 31*a* of the head 30 is air-tightly sealed; FIG. 43 shows a sealing member 50; and FIG. 4C shows the protector 21. FIG. 5A shows the head maintaining apparatus 100 in a state thereof after the nozzle surface 31*a* of the head 30 is sealed; and FIG. 5B shows engaging portions 60*h*, 70*c* of an upper case 70 and a lower case 60 of the apparatus 100.

The head maintaining apparatus 100 includes the sealing member 50 that air-tightly seals the nozzle surface 31*a*; the lower case 60 that holds the sealing member 50; the upper case 70 that cooperates with the lower case 60 to hold or accommodate the head holder 9 holding the inkjet head 30; and a sealing plug 80 that air-tightly closes a communication hole 50*c* of the sealing member 50.

The sealing member 50 is formed of an elastic material such as a rubber, and includes a plate-like base portion 50*a* and an annular lip portion 50*b* projecting from an upper surface of the base portion 50*a*. The lip portion 50*b* can air-tightly contact and cover the nozzle surface 31*a* such that the lip portion 50*b* surrounds all the nozzles 35, 36, 37, 38 (FIG. 3) and cooperates with the nozzle surface 31*a* to define an air-tightly inner space 51. The communication hole 50*c* that communicates with each of two opposite surfaces of the sealing member 50 is formed through a thickness of a portion of the base portion 50*a* that is surrounded by the annular lip portion 50*b*.

The sealing plug 80 includes a plate-like head portion 80*b* that can be pushed with a finger of a person, and an insertion portion 80*a* that projects from a central portion of the head portion 80*b* and can be inserted into the communication hole 50*c* of the sealing member 50. The insertion portion 80*a* has a transverse cross section whose size is somewhat larger than that of the communication hole 50*c*, and has an axial length assuring that the insertion portion 80*a* can be inserted into the communication hole 50*c* via a bottom hole 60*e* of the lower case 60.

The lower case 60 has a box-like shape having an upper open end 60*a*, a bottom wall 60*b*, and a leg portion 60*c* that defines a prescribed space below the bottom wall 60*b*.

A holding portion 60*d* that holds the sealing member 50 at a prescribed position is provided on an upper surface of the bottom wall 60*b*, such that the holding portion 60*d* projects upward from the upper surface. The bottom hole 60*e* is formed through a thickness of a portion of the bottom wall 60*b* that corresponds to the communication hole 50*c* of the sealing member 50 in the state in which the sealing member 50 is held by the holding member 60*d*, so that the inner space 51 defined by the sealing member 50 communicates with an outer space located outside the lower case 60, i.e., the atmosphere. The lower case 60 has, in an inner space thereof, two plate-like guide members 60*f* that cooperate with each other to guide the head holder 9 to a prescribed position. In addition, the two guide members 60*f* cooperate with each other to support the head holder 9 such that the nozzle surface 31*a* keeps its horizontal posture, and position the holder 9 such that the nozzle surface 31*a* contacts the lip portion 50*b* of the sealing member 50.

The upper case 70 has a box-like shape having a lower open end that allows the upper case 70 to cover externally the upper open end 60*a* of the lower case 60. The upper case 70 has, on a lower surface of a top wall thereof, two pressing members 70*a* that project in the downward direction and that contact two portions of an upper surface of the cover member 9*d* of the head holder 9, respectively, and press the holder 9 in the downward direction, in the state in which the upper case 70 is engaged with the lower case 60. In the present embodiment, each of the two pressing members 70*a* has a plate-like shape.

Method of Maintaining Inkjet Head 30

Next, there will be described a method of maintaining the inkjet head 30 by using the head maintaining apparatus 100.

First, the sealing member 50 whose communication hole 50*c* is kept open is held by the holding portion 60*d* of the lower case 60 and, in this state, the head holder 9 to which the protector 21 is attached is guided by the two guide members 60*f*, so that the nozzle surface 31*a* of the holder 9 is held in contact with the lip portion 50*b* of the sealing member 50. Thus, the sealing member 50 and the nozzle surface 31*a* cooperate with each other to define the inner space 51 inside the lip portion 50*b*. The inner space 51 communicates with the atmosphere via the communication hole 50*c* of the sealing member 50 and the bottom hole 60*e* of the bottom wall 60*b* of the lower case 60.

In this state, the tube joint 20 has not been attached to the head holder 9 yet, that is, the protector 21 remains attached to the head holder 9. As shown in FIG. 4C, the protector 21 has, on opposite side surfaces thereof, two elastically deformable operable portions 21*a* that are operable with fingers of a person, and two engaging portions 21*b* that are integral with respective lower end portions of the two operable portions 21*a*. In a state in which the two engaging portions 21*b* of the protector 21 are engaged with a lower surface of the arm portion 9*a*, the protector 21 is attached to the head holder 9 while closing the four connection ports 40*f* of the buffer tank 40. Thus, the four color inks can be prevented from drying up through the connection ports 40*f*.

Meanwhile, when the head holder 9 is attached to the inkjet printer 1, the protector 21 is detached from the holder 9 by operating the two operable portions 21*a* and disengaging the two engaging portions 21*b* from the arm portion 9*a*, and then the tube joint 20 is attached to the arm portion 9*a*.

Subsequently, the upper case 70 is placed on the upper open end 60*a* of the lower case 60, so that the pressing members 70*a* contact the upper surface of the cover member 9*d*. Then, if the upper case 70 is pressed against the lower case 60, two fixing portions 70*b* that are provided on two opposite side surfaces of the upper case 70, as shown in FIGS. 5A and 5B,affix the upper and lower cases 70, 60 to each other, so that the nozzle surface 31*a* is pressed against the sealing member 50. More specifically described, the upper and lower cases 70, 60 are fixed to each other such that respective upper surfaces of the two first engaging portions 70*c* projecting inward from respective lower ends of the two fix portions 70*b* are engaged with respective lower surfaces of the two second engaging portions 60*h* projecting outward from two side walls 60*g* of the lower case 60. On the other hand, if two releasing portions 70*d* extending outward and upward from the respective lower ends of the two fixing portions 70*b* are pressed with fingers of a person, the two first engaging portions 70*c* are disengaged or released from the two second engaging portions 60*h*, so that the upper case 70 can be disengaged or separated from the lower case 60.

When the upper case 70 and the lower case 60 are engaged with each other, the sealing member 50 is pressed and the lip portion 50*b* thereof is deformed or compressed and is held in pressed contact with the nozzle surface 31*a*. Thus, a volume of the inner space 51 is decreased. Since, however, the inner space 51 communicates with the atmosphere via the communication hole 50*c* and the bottom hole 60*e*, an air pressure in the inner space 51 is not increased. Thus, a meniscus of the ink present in each of the nozzles 35 through 38 is not broken.

Then, the insertion portion 80*a* of the sealing plug 80 is inserted into the communication hole 50*c* via the bottom hole 60*e*. Since the size of the insertion portion 80*a* is somewhat larger than that of the communication hole 50*c*, an outer surface of the insertion portion 80*a* and an inner surface of the communication hole 50*c* are held in pressed contact with each other, owing to an elasticity of the sealing member 50. Thus, the communication hole 50*c* is closed by the sealing member 80 such that the inner space 51 is air-tightly isolated from the atmosphere.

The first embodiment relates to the inkjet printer 1. However, the principle of the present invention is applicable to other sorts of inkjet recording devices such as a facsimile machine.

Before the head holder 9 holding the inkjet head 30 is packaged in the head maintaining apparatus 100, the head holder 9 is subjected to an ejecting test, in a state in which the buffer tank 40 of the head holder 9 accommodates the four color inks, or a different liquid analogous with the inks. If each of the nozzles 35 through 38 of the inkjet head 30 normally ejects a droplet of ink, it can be said that a meniscus of the ink present in the each nozzle is formed at an appropriate position. Therefore, if the head holder 9 including the inkjet head 30 in this state is packaged in the head maintaining apparatus 100 and then is attached to the inkjet printer 1, the inkjet head 30 can normally start its ink ejecting operation in the inkjet printer 1.

Advantages of First Embodiment (1) In the above-described head maintaining apparatus 100 and the above-described head maintaining method, the sealing member 50 has the communication hole 50*c* that communicates, on one hand, with the inner space 61 defined between the sealing member 50 and the nozzle surface 31*a* when the sealing member 50 covers the nozzle surface 31*a*, and communicates, on the other hand, with the atmosphere. Thus, when the sealing member 50 covers the nozzle surface 31*a*, a certain amount of air present in the inner space 51 can be released into the atmosphere via the communication hole 50*c*, and accordingly the air pressure in the inner space 51 can be prevented from being excessively increased. Therefore, the meniscus of the ink present in each of the nozzles 86 through 38 can be reliably prevented from being broken.

In addition, since the communication hole 50*c* can be closed with the sealing plug 80, the inner space 51 can be air-tightly isolated from the atmosphere. Therefore, each of the nozzles 35 through 38 can be isolated from the atmosphere and the ink present in the each nozzle can be effectively prevented from being dried up.

(2) In the simple operation in which the inkjet head 30 is placed between the upper and lower cases 70, 60 and the upper case 70 is pressed against the lower case 60, the sealing member 50 is held in pressed contact with the nozzle surface 31*a*. Thus, the nozzle surface 31*a* can be air-tightly sealed with an improved efficiency.

In addition, since the inkjet head 30 is placed between the upper and lower cases 70, 60, the head 30 can be effectively prevented from colliding with something else. That is, the recording head 30 can be effectively protected, i.e., the head 30 cannot be broken.

(3) The communication hole 50*c* can be air-tightly closed with the sealing plug 80, through the bottom hole 60*e* formed in the bottom wall 60*b* of the lower case 60. Therefore, after the inkjet head 30 is placed between the upper and lower cases 70, 60, the nozzle surface 31*a* can be sealed.

(4) The communication hole 50*c* can be closed with the sealing plug 80, i.e., a simple member. Thus, the head maintaining apparatus 100 can be easily used and can be produced at low cost.

(5) Since the sealing member 60 is an elastic member, the sealing member 50 can air-tightly contact the nozzle surface 31*a* and accordingly can reliably seal the nozzle surface 31*a*. In addition, the insertion portion 80*b* of the sealing plug 80 can air-tightly contact the communication hole 50*c*, owing to an elastic restoring force of the sealing member 50. Thus, the nozzle surface 31*a* can be reliably isolated from the atmosphere.

(6) The sealing member 50 includes the annular lip portion 50*b* that surrounds the nozzles 35 through 38 and defines the inner space 51. Since the sealing member 60 does not contact the nozzles 35 through 38, the meniscus of the ink present in each of the nozzles can be effectively prevented from being contacted with, or broken by, the sealing member 50. In addition, the nozzles 35 through 38 are not damaged.

(7) In the recording-head maintaining apparatus100, the lower and upper cases 60, 70 cooperate with each other to hold the sealing member 50, and additionally holds the inkjet head 30 such that the head 30 is separable therefrom and the sealing member 50 is kept in pressed contact with the nozzle surface 31*a* of the head 30. Thus, an extra step of covering the nozzle surface 31*a* with the sealing member 50 can be omitted, which leads to improving the operation efficiency. In addition, since the sealing member 50 is held by the two cases 60, 70 and is effectively prevented from being moved out of position, the nozzle surface 31*a* can be reliably sealed by the sealing member 50.

Second Embodiments

Figure 6A:
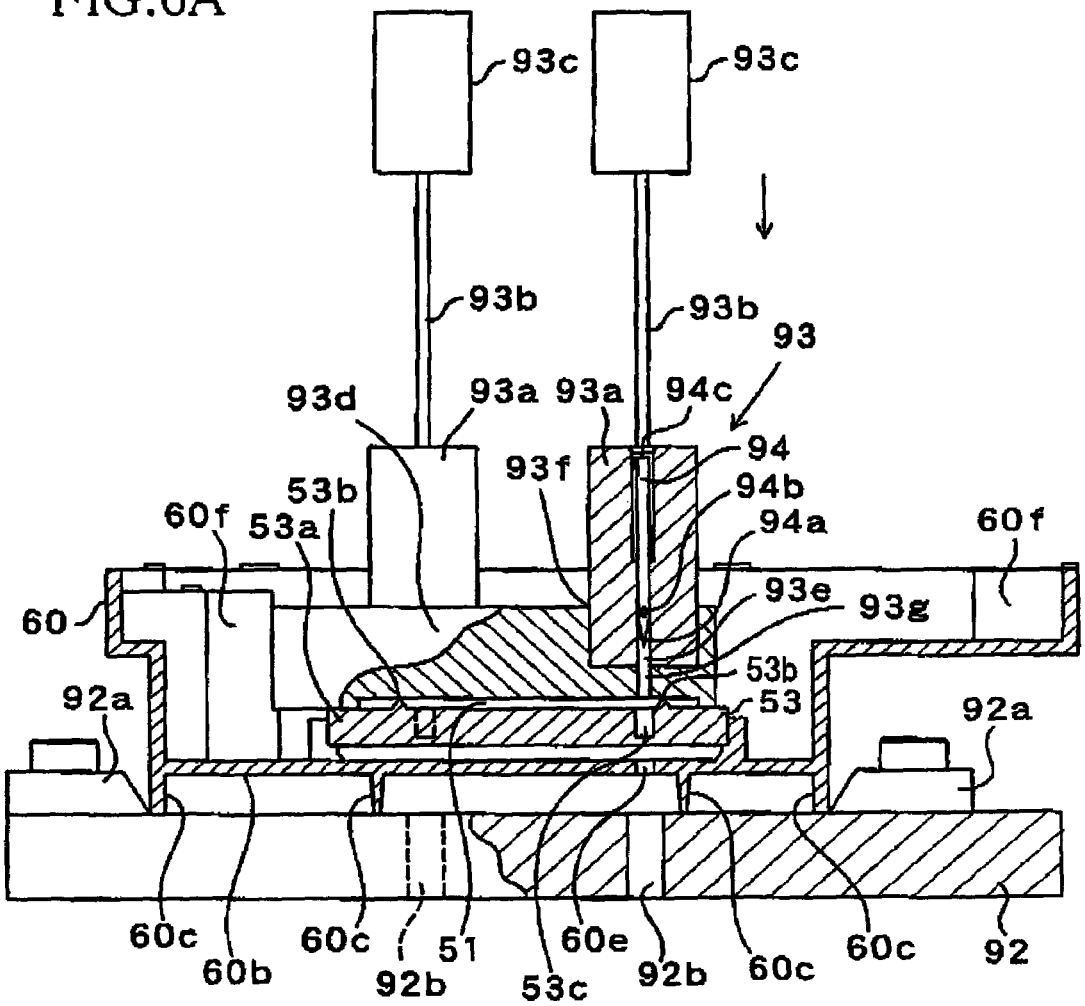
FIG. 6A is a partly cross-sectioned, side elevation view of a device for forming, with two needle-like members, two through-holes through a thickness of another sealing member of another recording-head maintaining apparatus as a second embodiment of the present invention.
Figure 6B:
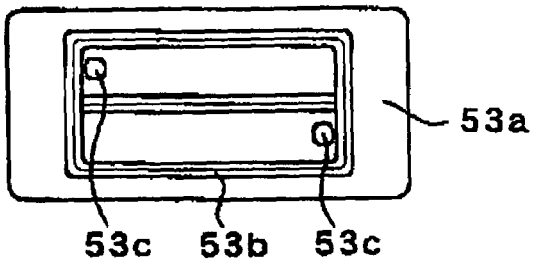
FIG. 6B is a plan view of the sealing member shown in FIG. 6A.
Figure 7A:
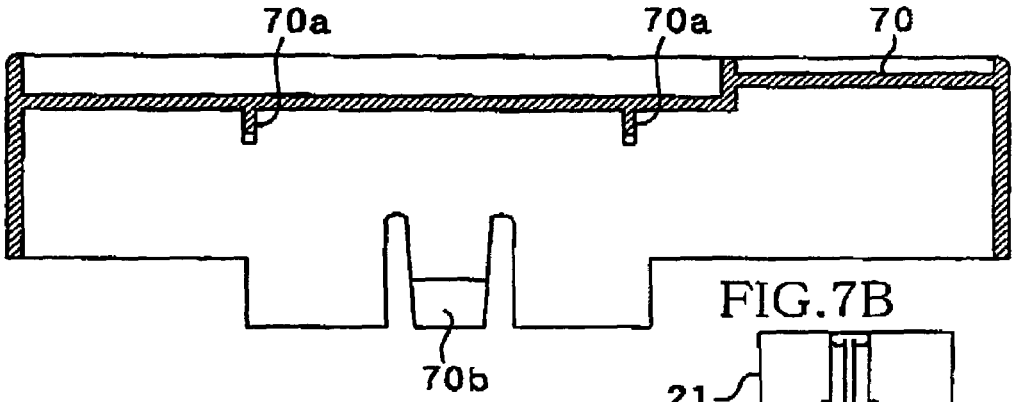
FIG. 7A is a partly cross-sectioned, side elevation view of an upper case of the recording-head maintaining apparatus of FIG. 6A.
Figure 7B:
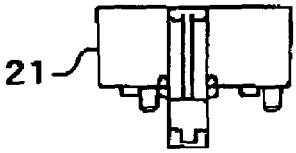
FIG. 7B is a side elevation view of a protector member of the recording-head maintaining apparatus of FIG. 6A.
Figure 7C:
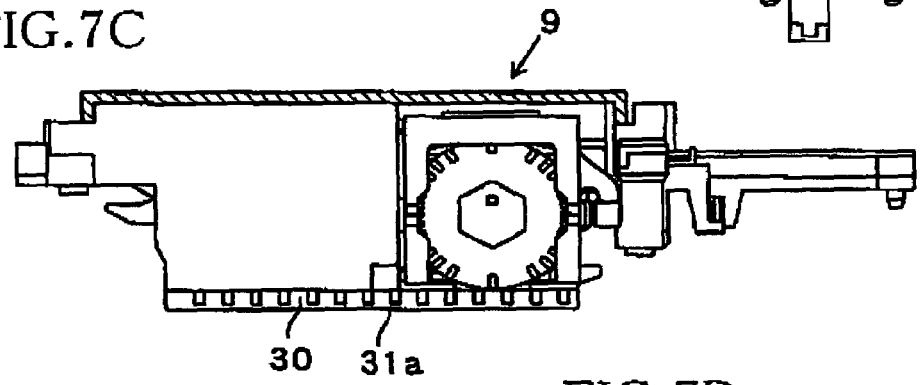
FIG. 7C is a partly cross-sectioned, side elevation view of a head holder holding a recording-head.
Figure 7D:
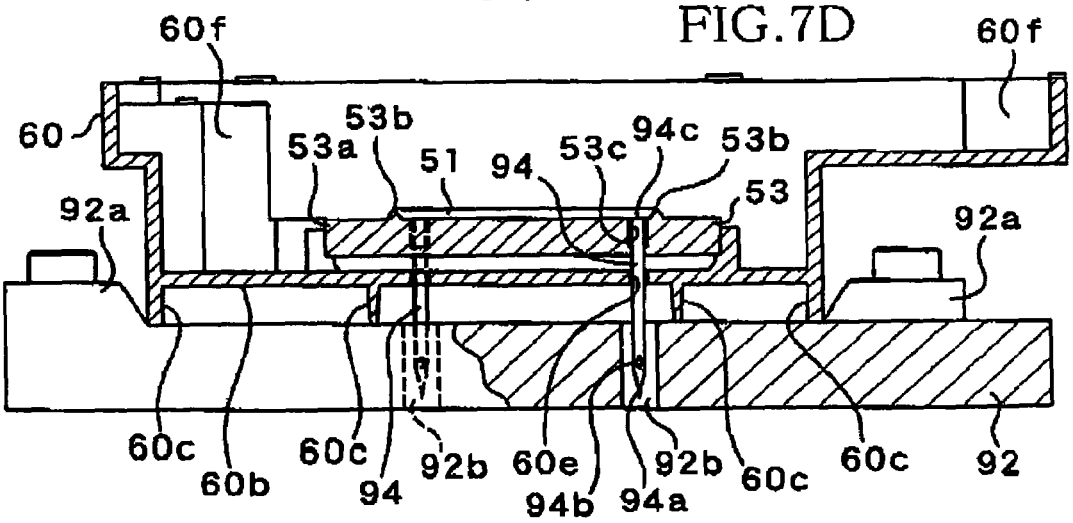
FIG. 7D is a partly cross-sectioned, side elevation view of the lower case of the recording-head maintaining apparatus of FIG. 6A in a state thereof in which the sealing member is penetrated by the two needle-like members.
Figure 8:
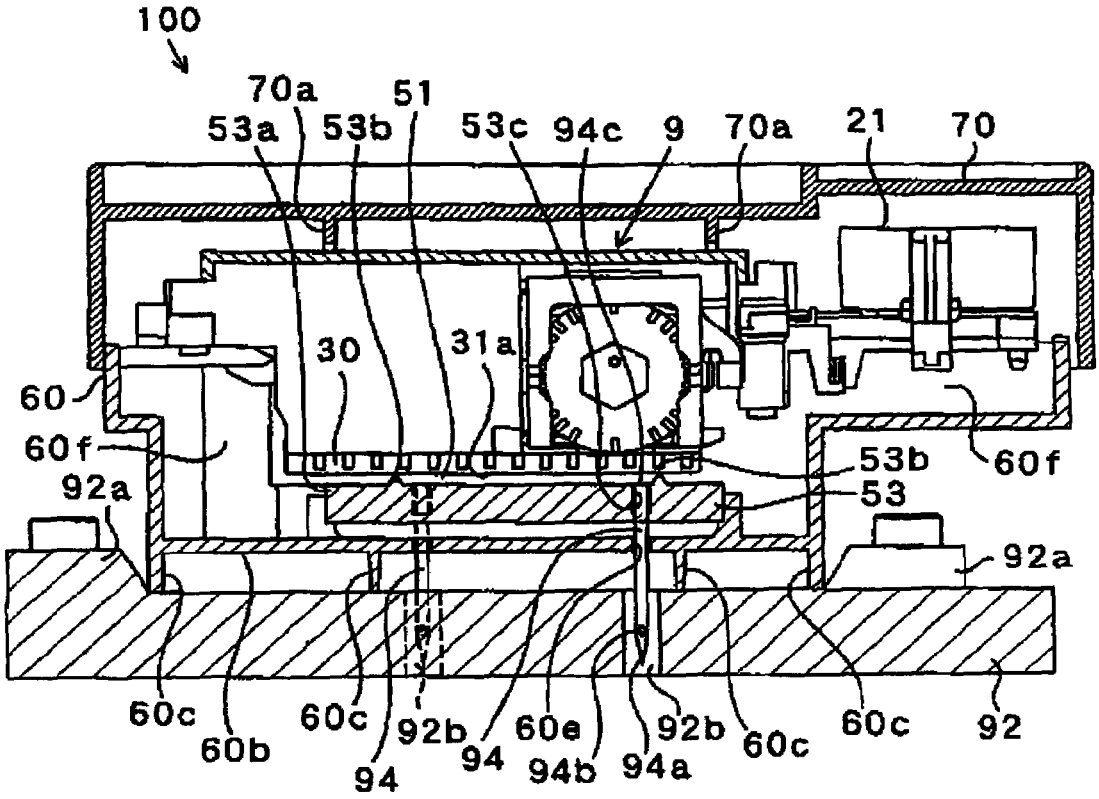
FIG. 8 is a partly cross-sectioned, side elevation view of the recording-head maintaining apparatus of FIG. 6A in a state thereof in which the maintaining apparatus holds the head holder holding the recording head.
Figure 9:
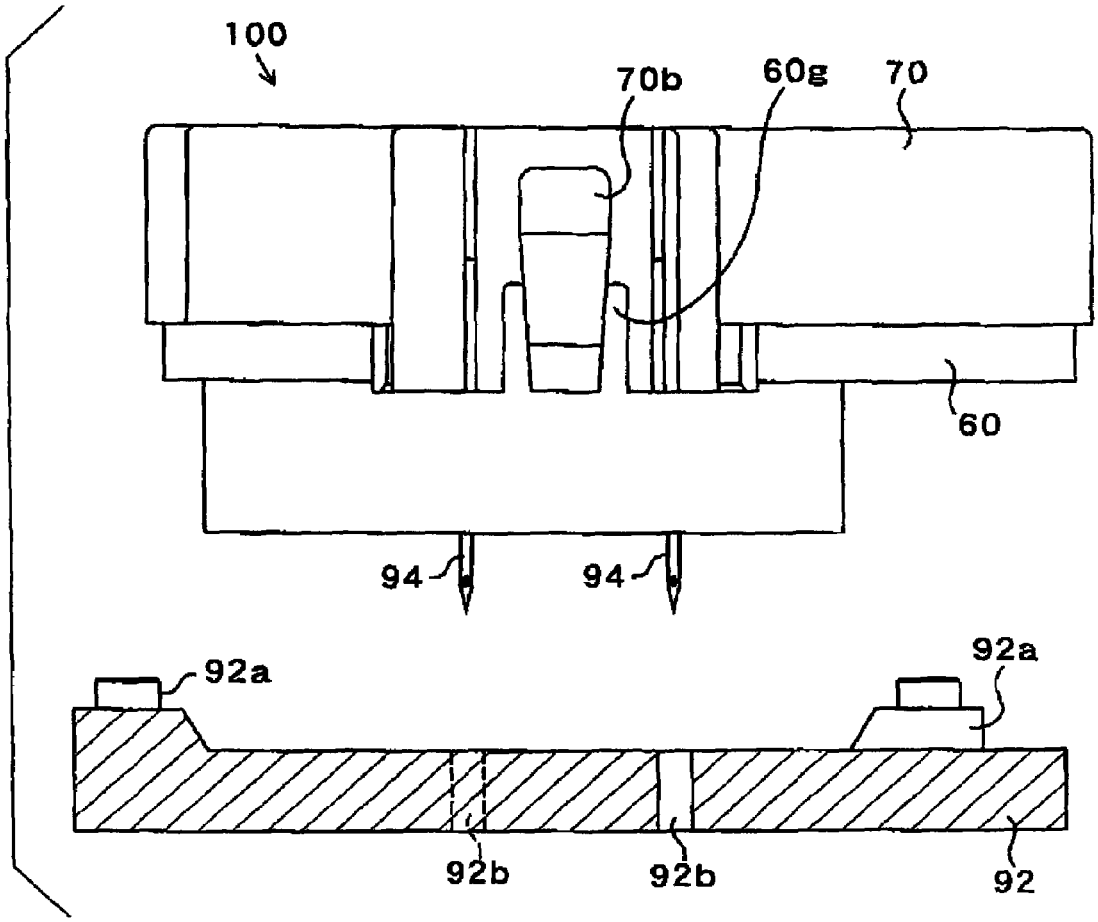
FIG. 9 is a view for illustrating a manner in which the recording-head maintaining apparatus of FIG. 6A is separated from an operation table.

Hereinafter, there will be described a second embodiment of the present invention by reference to FIGS. 6A, 6B, 7A, 7B, 7C, 7D, 8, and 9. The same reference numerals as used in the first embodiment are used to designate the corresponding elements or parts of the second embodiment, and the description of those elements or parts is omitted. FIG. 6A shows a device for forming two through-holes in a sealing member 53; FIG. 6B shows the sealing member 63; FIG. 7A shows an upper case 70; FIG. 7B shows a protector member 21; FIG. 7C shows a head holder 9; FIG. 7D shows a lower case 60 in a state in which the sealing member 53 placed in the lower case 60 are penetrated by two needle-like members 94; FIG. 8 shows a recording-head maintaining apparatus 100 in a state in which the maintaining apparatus 100 holds the head holder 9 holding the inkjet head 30; and FIG. 9 shows an operation table 92 and the head maintaining apparatus 100 removed from the operation table 92.

Construction of Head Maintaining Apparatus

In the second embodiment, five arrays of nozzles 85, 36, 37, 38 (FIG. 3) of an inkjet head 30 are grouped into two nozzle groups, i.e., a first nozzle group including the nozzles 35, 36 and a second nozzle group including the nozzles 37, 38. As shown in FIG. 6B, the sealing member 53 has two sections corresponding to the two nozzle groups. Thus, the device for forming the two through-holes in the sealing member 63, shown in FIG. 6A, includes the two needle-like members 94 and two penetration jigs 93 that correspond to the two nozzles groups, respectively. Each of the two penetration jigs 93 includes a guide portion 93*a*, a pusher portion 93*b*, and a stopper portion 93*c*. As shown in FIG. 6A, the sealing member 63 employed by the second embodiment has no communication holes like the communication hole 50*c* of the sealing member 60 employed in the first embodiment. More specifically described, the sealing member 53 includes a plate-like base portion 53*a* and a lip portion 53*b* projecting from an upper surface of the base portion 53*a*, and has two guide holes 53*c* at respective positions near to an inner circumferential surface of an outer annular portion of the lip portion 53*b*. The two guide holes 53*c* belong to the above-described two sections of the sealing member 53, respectively, and extend from the upper surface of the base portion 53*a* toward a lower surface thereof, but do not reach the lower surface. Thus, each of the two guide holes 53*c* has a bottom. A bottom wall 60*b* of the lower case 60 has two bottom holes 60*e* at respective positions corresponding to the two guide holes 53*c* of the sealing member 53.

Each of the two needle-like members 94 is a hollow member, and includes a sharp end portion 94*a* to penetrate the sealing member 53, and a side open hole 94*b* that is located near the end portion 94*a* and communicates with a rear open end 94*c* via a communication passage, not shown, formed in the each needle-like member 94.

The operation table 92 is for a person to perform an operation on the lower case 60 in a state in which the lower case 60 is held in position. More specifically described, the operation table 92 includes a positioning portion 92*a* that positions the lower case 60 at an appropriate position, and has two through-holes 92*b*, 92*b* that are formed through a thickness of the table 92 and into which the two needle-like members 94 are inserted.

Each of the two, penetration jigs 93 includes the guide portion 93*a* that guides the corresponding needle-like member 94 so that the needle-like member 94 may penetrate the corresponding guide hole 53*c* of the sealing member 63; and the bar-like pusher portion 93*b* that pushes the rear open end 94*c* of the needle-like member 94 so that the needle-like member 94 may penetrate the sealing member 53, and the through-hole forming device further includes a base member 93*d* that supports the guide portion 93*a* above the sealing member 53.

More specifically described, the guide portion 93*a* is fixed to a recessed portion 93*f* of the base portion 93*d* that has, in a bottom thereof, a through-hole 93*g*. The guide portion 93*a* has a guide passage 93*e* formed therethrough in an axial direction thereof, and the guide passage 93*e* holds the corresponding needle-like member 94 in a vertical direction. The through-hole 93*g* and the guide passage 93*e* communicate with each other, and are located at a position right above the corresponding guide hole 53*c* of the sealing member 53.

The base member 93*d* is guided by the two guide members 60*f* of the lower case 60, so that a lower surface of the base member 93*d* is contacted with the sealing member 53.

Each of the two penetration jigs 93 has, in an upper end portion thereof, the stopper portion 93*c* that limits an amount of movement of the pusher portion 93*b* to push the corresponding needle-like member 94 into the sealing member 53.

Method of Penetrating Sealing Member 53

Next, a method of penetrating, using the two needle-like members 94, will be described, the sealing member 53 so as to form two communication passages each of which communicates, at one end thereof, with a corresponding one of two inner spaces 51 corresponding to the above-described two nozzle groups, respectively, and communicates, at the other end thereof, with an atmosphere. First, the lower case 60 holding the sealing member 53 is placed on the operation table 92, and then the two penetration jigs 93 and the base member 93*d* are placed on the upper surface of the sealing member 53. In this state, the two through-holes 92*b* of the operation table 92 are aligned with the two guide holes 53*c* of the sealing member 53 via the two bottom holes 60*e* of the lower case 60, respectively.

Subsequently, the two needle-like members 94 are inserted in the respective guide portions 53*a* of the two penetration jigs 93, and the respective pusher portions 93*b* of the two jigs 93 are operated to push the respective rear open ends 94*c* of the two needle-like members 94 in a downward direction.

Then, the two needle-like members 94 are caused to penetrate the sealing member 53, till respective lower surfaces of the two stopper portions 93*c*, but on respective upper surfaces of the two guide portions 93*a*. Thus, as shown in FIG. 7D, the respective end portions 94*a* of the two needle-like members 94 penetrate the sealing member 53 via the two guide holes 53*c*, and extend through the two bottom holes 60*e* of the lower case 60 and reach respective intermediate portions of the two through-holes92*b* of the operation table 92. In addition, the respective rear open ends 94*c* of the two needle-like members 94 are made substantially flush with the upper surface of the base portion 53*a* of the sealing member 53. Since respective rear or base end portions of the two needle-like members 94 that penetrate the sealing member 53 are held by an elastic restoring force of the sealing member 53, the needle-like members 94 are fixed to the sealing member 53 in a state in which the needle-like members 94 penetrate the sealing member 53. In this state, the respective rear open ends 94*c* of the two needle-like members 94 are exposed in the two inner spaces 51, and the respective side open holes 94*b* of the needle-like members 94 are exposed to the atmosphere outside the lower case 60. Thus, the two inner spaces 51 and the atmosphere outside the lower case 60 communicate with each other via the two needle-like members 94, respectively.

Method of Maintaining Inkjet Head 30

Next, there will be described a method of maintaining, using the head maintaining apparatus 100, the inkjet head 30.

First, the two penetration jigs 93 and the base member 93*d*, shown in FIG. 6A, are removed from the lower case 60, and then the head holder 9 (FIG. 7C) to which the protector (FIG. 7B) is attached is guided by the two guide members 60*f* so that the nozzle surface 31*a* of the inkjet head 30 held by the head holder 9 is held in contact with the lip portion 53*b* of the sealing member 53.

Next, the upper case (FIG. 7A) is attached to an upper open end portion 60*a* of the lower case 60, in the same manner as that employed in the first embodiment, so that the head holder 90 is held, as shown in FIG. 8, between the lower case 60 and the upper case 70.

Since the sealing member 53 is compressed, the lip portion 53*b* is elastically deformed and is held in pressed contact with the nozzle surface 31*a*. Thus, the respective volumes of the two inner spaces 51 are decreased by the elastic deformation of the lip portion 53*b*. Since, however, the two inner spaces 51 communicate with the outer atmosphere via the two needle-like members 94, respectively, respective air pressures in the two inner spaces 51 are not increased. Thus, respective meniscuses of the inks present in the nozzles 35 through 38 (FIG. 3) are not broken.

Then, as shown in FIG. 9, the head maintaining apparatus 100 holding the head holder 9 is removed from the operation table 92, and the two needle-like members 94 penetrating the sealing member 53 are pulled out, using a tool such as a pair of pincers, from the sealing member 53 into an outside space. Consequently, the two through-holes formed by the penetration of the two needle-like members 94 are closed by the elastic restoring deformation of respective portions of the sealing member 53 that define the two through-holes. Thus, the two inner spaces 51 are air-tightly closed and accordingly the nozzle surface 31*a* is air-tightly sealed.

Advantages of Second Embodiment (1) In the above-described head maintaining apparatus 100 and the above-described head maintaining method, the inner spaces 51 formed between the sealing member 63 and the nozzle surface 31*a* when the sealing member 53 covers the nozzle surface 31*a*, are communicated with the atmosphere via the needle-like members 94 penetrating the sealing member 63, when the sealing member 53 is closely contacted with the nozzle surface 31*a*. Thus, the air present in the inner spaces 51 is discharged into the atmosphere via the needle-like members 94, and accordingly the inner pressure in the spaces 51 is prevented from being increased. Therefore, the respective meniscuses of the inks present in the nozzles 35 through 38 are not broken.

In addition, after the sealing member 53 is closely contacted with the nozzle surface 31*a*, the air communication between the two inner spaces 51 and the atmosphere is shut off. Therefore, the nozzles 35 through 38 are kept in an air-tight condition and accordingly the inks present in the nozzles are prevented from being dried up.

(2) The sealing member 53 formed of the elastic material is penetrated by the hollow, needle-like members 94, so that the inner spaces 51 formed between the sealing member 53 and the nozzle surface 31*a* are communicated with the atmosphere via the needle-like members 94. In addition, when the needle-like members 94 are pulled out of the sealing member 53, the through-holes formed by the penetration of the needle-like members 94 through the sealing member 53 are closed by the elastic restoring deformation of the sealing member 53 itself Thus, the nozzle surface 30*a* can be reliably sealed without using any exclusive members, like the sealing plug 80, for closing those through-holes.

In addition, since the through-holes formed in the sealing member 53 are automatically closed by the elasticity of the sealing member 53, the through-holes can be reliably closed.

(3) In the simple operation in which the inkjet head 30 is placed between the upper and lower cases 70, 60 and the upper case 70 is attached to the lower case 60, the sealing member 53 is held in pressed contact with the nozzle surface 31*a*. Thus, the nozzle surface 31*a* can be air-tightly sealed with an improved efficiency.

In addition, since the inkjet head 30 is held by, and between, the upper and lower cases 70, 60, the head 30 can be effectively prevented from colliding with other members. Thus, the inkjet head 30 can be effectively protected and accordingly it cannot be broken.

Third Embodiment

Figure 10:
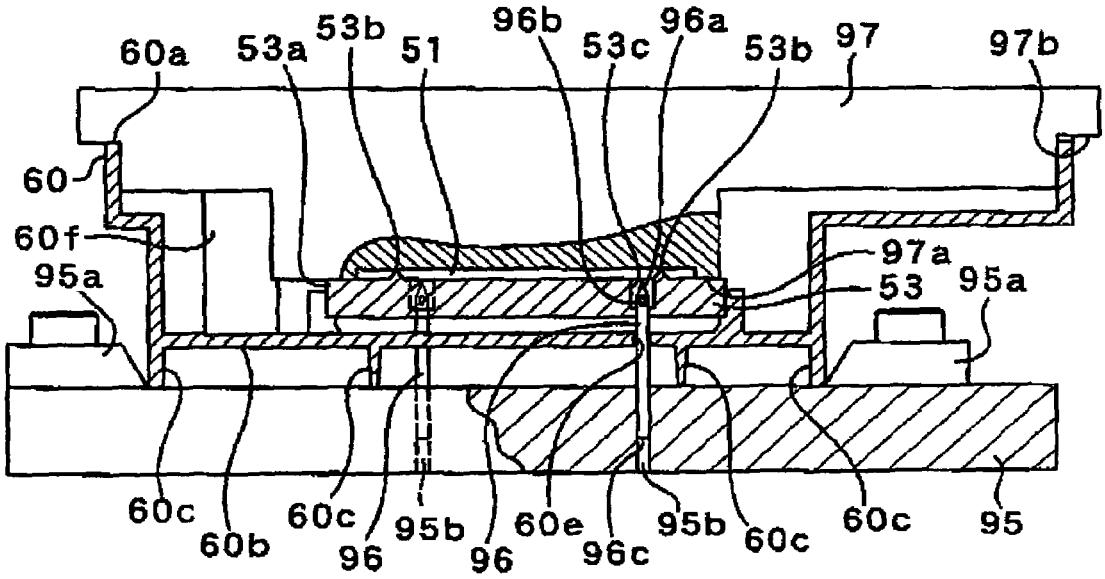
FIG. 10 is a partly cross-sectioned, side elevation view of a device for forming, with two needle-like members, two through-holes through a thickness of another sealing member of another recording-head maintaining apparatus as a third embodiment of the present invention.
Figure 11A:
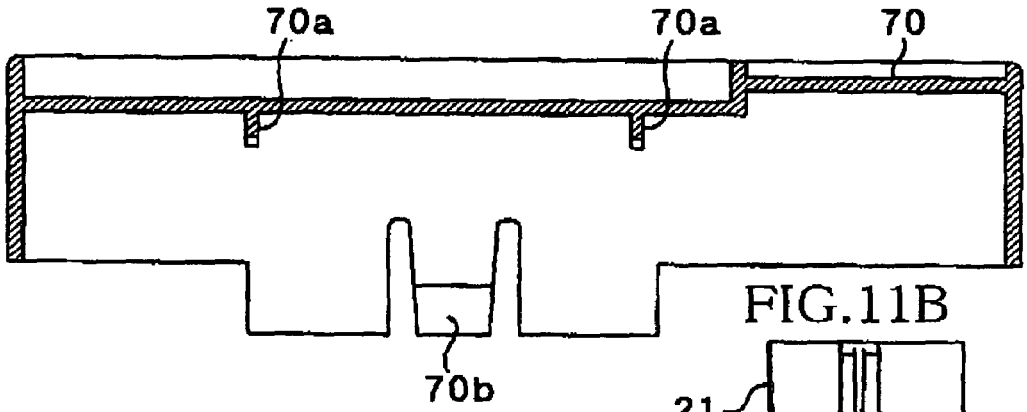
FIG. 11A is a partly cross-sectioned, side elevation view of an upper case of the recording-head maintaining apparatus of FIG. 10.
Figure 11B:
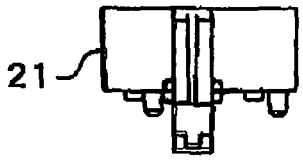
FIG. 11B is a side elevation view of a protector member of the recording-head maintaining apparatus of FIG. 10.
Figure 11C:
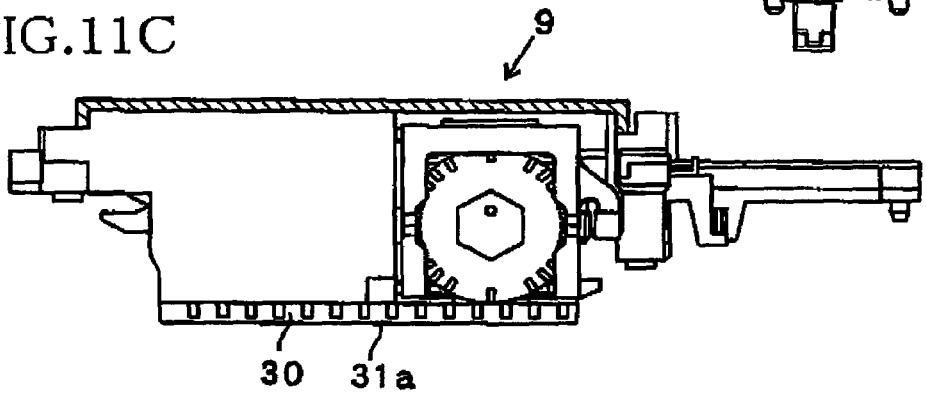
FIG. 11C is a partly cross-sectioned, side elevation view of a head holder holding a recording head.
Figure 11D:
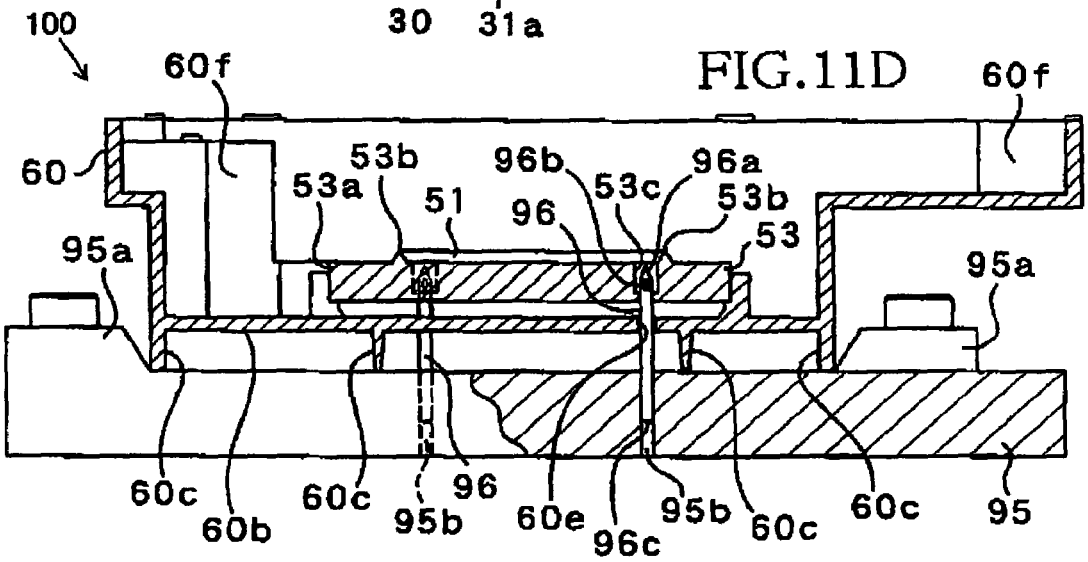
FIG. 11D is a partly cross-sectioned, side elevation view of a lower case of the recording-head maintaining apparatus of FIG. 10 in a state thereof in which the two through-holes are formed through the sealing member by the two needle-like members.

Hereinafter, there will be described a third embodiment of the present invention by reference to FIGS. 10, 11A, 11B, 11C, and 11D. The same reference numerals as used in the first and second embodiments are used to designate the corresponding elements or parts of the third embodiment, and the description of those elements or parts is omitted. FIG. 10 shows a device for penetrating, with two needle-like members 96, a sealing member 63 from a lower surface thereof FIG. 11A shows an upper case 70; FIG. 11B shows a protector member 21; FIG. 7C shows a head holder 9; and FIG. 7D shows a lower case 60 in a state in which the sealing member 53 placed in the lower case 60 are penetrated by the two needle-like members 96.

Construction of Device for Penetrating Sealing Member 53 with Needle-like Members 96

As shown in FIG. 10, this penetration device includes a penetration table 95 having, on an upper surface thereof, a positioning portion 95*a* that positions the lower case 60 at an appropriate position. The penetration table 95 has two through-holes 95*b*, 95*b* that are formed through a thickness of the table 95 and into which the two needle-like members 96 are fixedly inserted such that respective upper end portions 96*a* of the two needle-like members 96 project upward from the two through-holes 95*b*, 95*b*, respectively. The two through-holes 95*b*, 95*b* are formed at respective positions assuring that when the lower case 60 is placed on the penetration table 95, the respective upper end portions 96*a* of the two needle-like members 96 that project upward from the two through-holes 95*b*, 95*b*, can penetrate two guide holes 53*c* of the sealing member 53 via two bottom holes 60*e* of a bottom wall 60*b* of the lower case 60.

Each of the two needle-like members 96 includes a sharp end portion 96*a* to penetrate the sealing member 53, and a side open hole 96*b* that is located near the end portion 96*a* and communicates with a rear open end 96*c* via a communication passage, not shown, formed in the each needle-like member 96.

The penetration device additionally includes a pushing jig 97 having a shape similar to that of the head holder 9(FIG. 9). The pushing jig 97 has, in a lower end thereof, a pushing portion 97*a* that pushes an outer peripheral portion of the upper surface of the sealing member 53 that is located outside the lip portion 53*b*, and additionally has, in an upper end thereof, an engaging portion 97*b* that covers an upper open end 60*a* of the lower case 60 and extends outward from the upper open end 60*a*.

Method of Penetrating Sealing Member 53

Next, there will be descried a method of penetrating, using the two needle-like members 96 fixed to the penetration table 95, the sealing member 53 so as to form two communication passages each of which communicates, at one end thereof, with a corresponding one of two inner spaces 51 corresponding to the above-described two nozzle groups, respectively, and communicates, at the other end thereof, with the atmosphere. First, the pushing jig 97 is attached to the lower case 60 through the upper open end 60*a* thereof. The pushing jig 97 is guided by two guide members 60*f* of the lower case 60, so that the pushing portion 97*a* is held in contact with the upper surface of the sealing member 53. In this state, the engaging portion 97*b* of the pushing jig 97 is engaged with the upper open end 60*a* of the lower case 60. Thus, when an upper surface of the pushing jig 97 is pushed by a person, the lower case 60 is pressed against the penetration table 95 while the sealing member 53 is prevented from being moved relative to the lower case 60.

Subsequently, the pushing jig 97 is pushed downward against the lower case 60, so that the lower case 60 is pushed against the penetration table 95. Thus, the two needle-like members 96 are caused to pass through the two bottom holes 60*e* of the lower case 60, respectively, and the respective upper end portions 96*a* of the two needle-like members 96 penetrate the two guide holes 53*c* of the sealing member 53, respectively, from the lower surface of the sealing member 53. When a leg portion 60*c* of the lower case 60 is contacted with the upper surface of the penetration table 92 and the pushing of the lower case 60 is finished, the respective side open holes 96*b* of the two needle-like members 96 are exposed in the two guide holes 53*c* of the sealing member 53, without projecting upward beyond the upper surface of the plate-like base portion 53*a* of the sealing member 53. Thus, the two inner spaces 51 are communicated with the atmosphere under the penetration table 95.

Method of Maintaining Inkjet Head 30

Next, there will be described a method of maintaining, using the head maintaining apparatus 100, the inkjet head 30.

First, the pushing jig 97, shown in FIG. 10, is removed from the lower case 60, and then the head holder 9 (FIG. 11C) to which the protector (FIG. 11B) is attached is guided by the guide members 60*f* so that the nozzle surface 31*a* of the inkjet head 30 held by the head holder 9 is held in contact with the lip portion 53*b* of the sealing member 53.

Next, the upper case (FIG. 11A) is attached to the upper open end portion 60*a* of the lower case 60, in the same manner as that employed in the second embodiment, so that the head holder 9 is held between the lower case 60 and the upper case 70.

Since the sealing member 53 is compressed, the lip portion 53*b* is elastically deformed and is held in pressed contact with the nozzle surface 31a. Thus, the respective volumes of the two inner spaces 51 are decreased by the elastic deformation of the lip portion 63*b*. Since, however, the two inner spaces 51 communicate with the atmosphere via the two needle-like members 96, respectively, respective air pressures in the two inner spaces 51 are not increased. Thus, respective meniscuses of the inks present in the nozzles 36 through 38 (FIG. 3) are not broken.

Then, the head maintaining apparatus 100 holding the head holder 9 is removed from the penetration table 95, so that the two needle-like members 96 penetrating the sealing member 53 are pulled out of the sealing member 53. Consequently, the two through-holes formed by the penetration of the two needle-like members 96 are closed by the elastic restoring deformation of respective portions of the sealing member 53 that define the two through-holes. Thus, the two inner spaces 51 are air-tightly closed and accordingly the nozzle surface 31*a* is air-tightly sealed.

Advantages of Third Embodiment (1) In the above-described head maintaining apparatus 100 and the above-described head maintaining method, the two inner spaces 51 formed between the sealing member 53 and the nozzle surface 31*a* when the sealing member 53 covers the nozzle surface 31*a*, are communicated with the atmosphere via the needle-like members 96 penetrating the sealing member 53, when the sealing member 53 is air-tightly contacted with the nozzle surface 31*a*. Thus, the air present in the inner spaces 61 is discharged into the atmosphere via the needle-like members 96, and accordingly the inner pressure in the spaces 51 is prevented from being increased. Therefore, the respective meniscuses of the inks present in the nozzles 35 through 38 are not broken.

In addition, after the sealing member 53 is closely contacted with the nozzle surface 31*a*, the air communication between the two inner spaces 51 and the atmosphere is shut off. Therefore, the nozzles 35 through 38 are kept in an air-tight condition and accordingly the inks present in the nozzles are prevented from being dried up.

(2) The sealing member 53 formed of the elastic material is penetrated by the hollow, needle-like members 96, so that the inner spaces 51 formed between the sealing member 53 and the nozzle surface 31*a* are communicated with the atmosphere via the needle-like members 96. In addition, when the needle-like members 96 are pulled out of the sealing member 53, the through-holes formed by the penetration of the needle-like members 96 through the sealing member 53 are closed by the elastic restoring deformation of the sealing member 53 itself. Thus, the nozzle surface 30*a* can be reliably sealed without using any exclusive members,. like the sealing plug 80, for closing those through-holes.

In addition, since the through-holes formed in the sealing member 53 are automatically closed by the elasticity of the sealing member 53, those through-holes can be reliably closed.

Moreover, since the needle-like members 96 are fixed to the penetration table 95, the needle-like members 96 can be pulled out of the sealing member 53, by removing the head maintaining apparatus 100 from the penetration table 95. Thus, a step of pulling the needle-like members 96 only from the sealing member 63 is not needed, which leads to improving an operation efficiency.

(3) In the simple operation in which the inkjet head 30 is placed between the upper and lower cases 70, 60 and the upper case 70 is attached to the lower case 60, the sealing member 53 is held in pressed contact with the nozzle surface 31*a*. Thus, the nozzle surface 31*a* can be air-tightly sealed with an improved efficiency.

In addition, since the inkjet head 30 is held by, and between, the upper and lower cases 70, 60, the head 30 can be effectively prevented from colliding with other members, Thus, the inkjet head 30 can be effectively protected and accordingly it cannot be broken.

Figure 12:
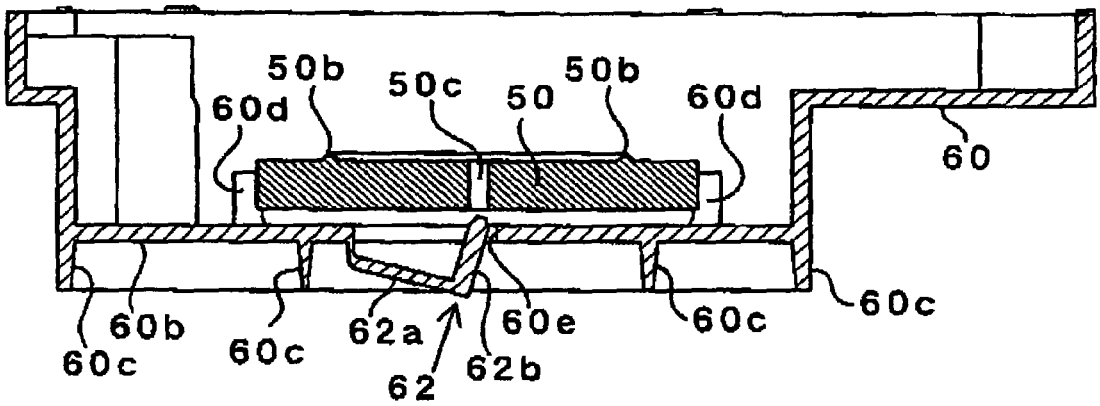
FIG. 12 is a view of a sealing plug that is formed as an integral portion of a lower case of another recording-head maintaining apparatus as a fourth embodiment of the present invention.

Other Embodiments (1) The sealing plug 80 employed in the first embodiment may be replaced with a sealing plug that is integral with a lower case 60, as shown in FIG. 12. In a fourth embodiment shown in FIG. 12, a sealing plug 62 is formed as an integral portion of the lower case 60. The sealing plug 62 includes an arm portion 62*a* that extends downward from an edge of a bottom hole 60*e* of the lower case 60, and an insertion portion 62*b* that projects from an end portion of the arm portion 62*a* and can be inserted in a communication hole 60*c* of a sealing member 50. The arm portion 62*a* has an appropriate degree of flexibility, and accordingly allows a person to insert the insertion portion 62*b* into the communication hole 50*c*, so that the insertion portion 62*b* is fixed by an elasticity of the sealing member 50. Thus, a space 51 defined by, and between, the sealing member 50 and a nozzle surface 31*a* can be air-tightly sealed. In this embodiment, the insertion portion 62*b* is integral with the lower case 60 and accordingly it is prevented from being lost. In addition, the present head maintaining apparatus can enjoy the same advantages as those of the head maintaining apparatus 100 as the first embodiment.

Figure 13:
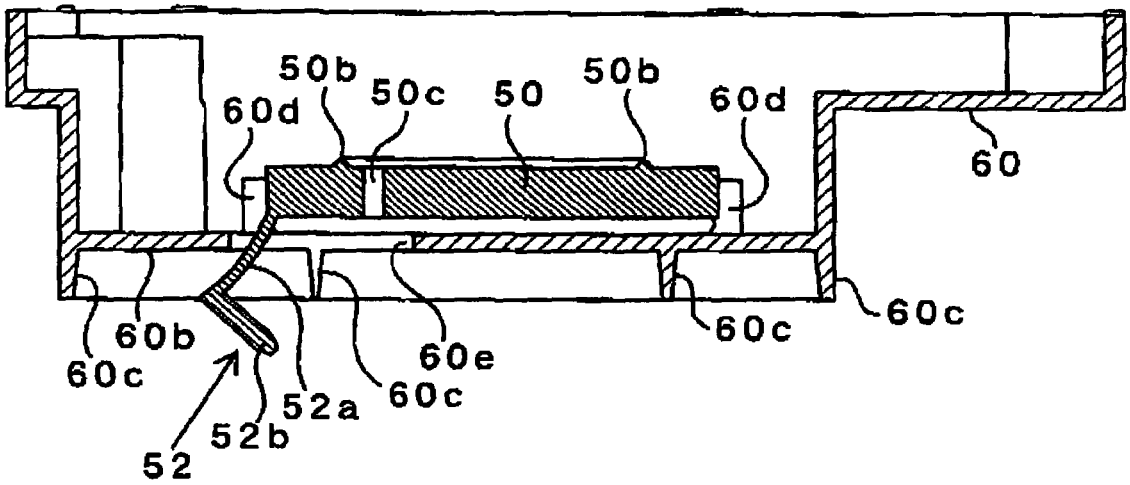
FIG. 13 is a view of another sealing plug that is formed as an integral portion of another sealing member of another recording-head maintaining apparatus as a fifth embodiment of the present invention.

(2) The sealing plug 80 employed in the first embodiment may be replaced with a sealing plug that is integral with a sealing member 50, as shown in FIG. 13. In a fifth embodiment shown in FIG. 13, a sealing plug 52 is formed as an integral portion of the sealing member 50. The sealing plug 62 includes an arm portion 62*a* that extends downward from one end of a lower surface of the sealing member 60, and an insertion portion 52*b* that projects from an end portion of the arm portion 52*a* and can be inserted in a communication hole 50*c* of the sealing member 50. The arm portion 52*a* has an appropriate degree of flexibility, and accordingly allows a person to insert the insertion portion 52*b* into the communication hole 50*c*, so that the insertion portion 52*b* is fixed by an elasticity of the sealing member 50. Thus, a space 51 defined by, and between, the sealing member 50 and a nozzle surface 31*a* can be air-tightly sealed. In this embodiment, the insertion portion 52*b* is integral with the sealing member 50 and accordingly it is prevented from being lost. In addition, the present head maintaining apparatus can enjoy the same advantages as those of the head maintaining apparatus 100 as the first embodiment.

Figure 14:
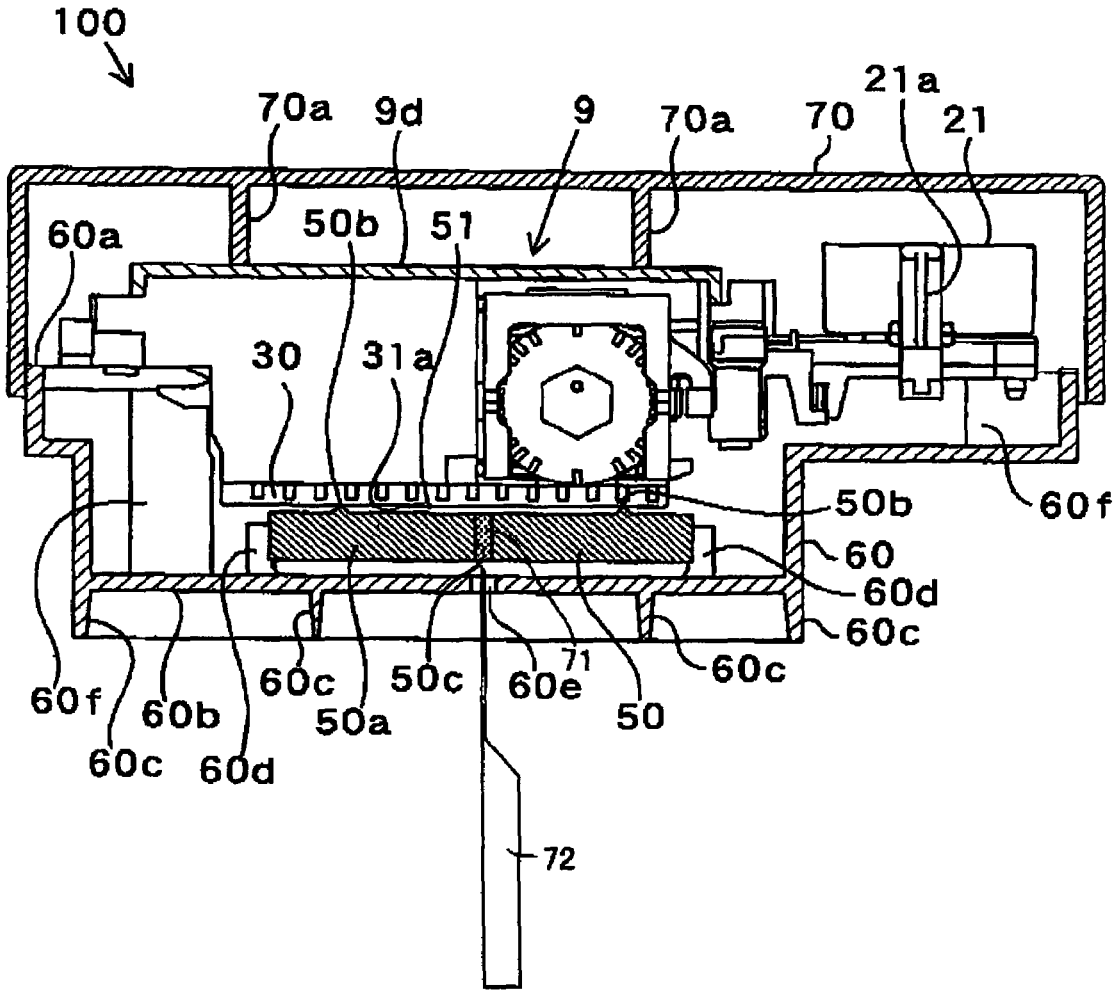
FIG. 14 is a view of a packing material that closes a communication hole formed through a thickness of another sealing member of another recording-head maintaining apparatus as a sixth embodiment of the present invention.

(3) The sealing plug 80, 62, 52 as a closing member that closes the communication hole 50*c* of the sealing member 50 may be replaced by a packing material 71 such as an adhesive or a putty, as shown in FIG. 14. The packing material 71 is injected to the communication hole 50*c*, by an injecting member 72 such as a syringe. Since the communication hole 50*c* is air-tightly closed by the packing material 71, the present arrangement is free from a problem that the closing member such as the sealing plug 80, 62, 52 may come off the sealing member 60. Thus, the communication hole 50*c* can be closed with reliability. This embodiment can also enjoy the same advantages as those of the head maintaining apparatus 100 as the first embodiment.

(4) The sealing member 50, 58 may be pressed against the nozzle surface 31*a* of the inkjet head 30, by fixing the head holder 9 and the lower case 60 to each other. For example, an outer surface of the head holder 9 and an upper end of the lower case 60 are provided with respective hooks, and the head holder 9 and the lower case 60 are fixed to each other, by causing those hooks to be engaged with each other, such that the nozzle surface 31*a* of the head holder 9 is pressed against the sealing member 50, 53. This embodiment can also enjoy the same advantages as those of the head maintaining apparatus 100 as each of the first to third embodiments.

In each of the illustrated embodiments, the recording sheet P corresponds to a recording medium; the inkjet head 30 corresponds to a recording head; the inkjet printer 1 corresponds to a recording device; a portion of the inkjet printer 1 that excludes the head holder 9 corresponds to a remaining portion of the recording device; and the sealing plug 80, 62, 52, the elasticity of the sealing member 53, or the packing material 71 corresponds to air-tightly closing means.

In addition, at least one of the lower case 60 and the upper case 70 corresponds to at least one holding member; the bottom hole 60*e* corresponds to an opening; and the bottom wall 60*b* corresponds to the wall that covers one of two opposite surfaces of the sealing member 50, 53 that is opposite to the other opposite surface thereof that is opposed to the nozzle surface 31*a* of the inkjet head 30 as the recording head.

The sealing plug 80 (or the insertion portion 80*a* thereof), the sealing plug 52 (or the insertion portion 52*b* thereof), or the sealing plug 62 (or the insertion portion 62*b* thereof) corresponds to a plug.

At least one of the needle-like members 94, 96 corresponds to at least one tubular member.

It is to be understood that the present invention may be embodied with other changes and improvements that may occur to a person skilled in the art, without departing from the spirit and scope of the invention defined in the claims.

What is claimed is:

1. An apparatus for maintaining a recording head which is for use as a portion of a recording device, in a recording-head maintaining state in which the recording head is not attached to a remaining portion of the recording device, wherein the remaining portion includes at least a portion of an ink communication passage connected to the recording head during a recording operation, the recording head having at least one nozzle opening in a nozzle-defining surface thereof for ejecting at least one droplet of ink toward a recording medium, the apparatus comprising:

an elastically deformable cover member which is adapted to air-tightly contact the recording head to cover the nozzle-defining surface thereof such that a space filled with air is formed between the elastically deformable cover member and the nozzle-defining surface; and selectively communicating means configured to selectively take (a) a first state thereof in which the selectively communicating means allows said space to communicate with an atmosphere so that substantially no difference is produced between an air pressure in said space and an atmospheric pressure while the elastically deformable cover member is air-tightly contacted with the recording head, and a volume of said space is decreased by elastic deformation of at least a portion of the elastically deformable cover member and (b) a second state thereof in which the selectively communicating means shuts off communication between said space and the atmosphere, and air-tightly closes said space, after the elastically deformable cover member has been air-tightly contacted with the recording head.

2. The apparatus according to claim 1, wherein the selectively communicating means comprises at least one communication hole which is formed through a thickness of the cover member to establish the first state; and air-tightly closing means for air-tightly closing said at least one communication hole to establish the second state.

3. The apparatus according to claim 2, wherein the air-tightly closing means comprises at least one plug which air-tightly closes said at least one communication hole of the cover member.

4. The apparatus according to claim 3, wherein the air-tightly closing means further comprises at least one flexible arm which is connected, at an end thereof, to said at least one plug and is connected, at an other end thereof, to the cover member.

5. The apparatus according to claim 2, wherein the air-tightly closing means comprises a packing material which air-tightly closes said at least one communication hole of the cover member.

6. The apparatus according to claim 1, further comprising at least one holding member which holds, at a position separate from the recording device, the cover member and the recording head such that the cover member is kept in pressed contact with the nozzle-defining surface of the recording head and such that the recording head is separable from the cover member and said at least one holding member so that the recording head is attached to the remaining portion of the recording device.

7. The apparatus according to claim 6, comprising a plurality of said holding members including a first holding member which holds, at said position separate from the recording device, the cover member, and a second holding member which cooperates with the first holding member to hold the recording head, wherein the first and second holding members include respective engageable portions which are engaged with each other so as to keep the cover member in pressed contact with the nozzle-defining surface of the recording head.

8. The apparatus according to claim 7, wherein the first holding member includes:

a holding portion which holds the cover member; and a positioning portion which positions the recording head relative to the cover member held by the holding portion, such that the nozzle-defining surface of the recording head contacts the cover member, and wherein, in a state in which the nozzle-defining surface of the recording head contacts the cover member, the respective engageable portions of the first and second holding members are engaged with each other so as to keep the cover member in pressed contact with the nozzle-defining surface of the recording head.

9. The apparatus according to claim 7, wherein the apparatus maintains the recording head in the recording-head maintaining state in which an entirety of the recording head is encapsulated by the first and second holding members.

10. The apparatus according to claim 6, wherein the selectively communicating means comprises at least one communication hole which is formed through a thickness of the cover member to establish the first state; and air-tightly closing means for air-tightly closing said at least one communication hole to establish the second state, wherein said at least one holding member includes a wall which covers one of opposite surfaces of the cover member which is opposite to an other of the opposite surfaces thereof which is opposed to the nozzle-defining surface of the recording head, and wherein the wall of said at least one holding member has at least one opening which allows said at least one communication hole of the cover member to communicate with the atmosphere outside said at least one holding member, and which has a size that allows the air-tightly closing means to be applied therethrough from a position outside said at least one holding member to said at least one communication hole of the cover member so as to close said at least one communication hole.

11. The apparatus according to claim 10, wherein the air-tightly closing means is independent of each of the cover member and said at least one holding member, and is applied from said position outside said at least one holding member to said at least one communication hole of the cover member so as to close said at least one communication hole.

12. The apparatus according to claim 6, wherein the selectively communicating means comprises at least one communication hole which is formed through a thickness of the cover member to establish the first state; and air-tightly closing means for air-tightly closing said at least one communication hole to establish the second state, and wherein the air-tightly closing means comprises at least one plug which air-tightly closes said at least one communication hole of the cover member; and at least one flexible arm which is connected, at an end thereof, to said at least one plug and is connected, at an other end thereof, to said at least one holding member.

13. The apparatus according to claim 6, wherein said at least one holding member includes a holding portion which holds the cover member and a positioning portion which positions the recording head relative to the cover member held by the holding portion, such that the nozzle-defining surface of the recording head contacts the cover member.

14. The apparatus according to claim 1, wherein the cover member is formed of an elastic material.

15. The apparatus according to claim 14, wherein the cover member includes an annular lip portion which surrounds said at least one nozzle of the recording head and has at least one inner space providing said space between the nozzle-defining surface and the cover member.

16. The apparatus according to claim 14, wherein the selectively communicating means comprises an elasticity of the cover member; and at least one through-hole which is formed through a thickness of the cover member by at least one tubular member which is caused to penetrate the cover member and keep said at least one through-hole open to allow said space to communicate, therethrough, with the atmosphere and then is pulled out of the cover member to close said at least one through-hole owing to the elasticity of the cover member.

17. A method of maintaining, with the apparatus according to claim 1, a recording head which is for use as a portion of a recording device; in a recording-head maintaining state in which the recording head is not attached to a remaining portion of the recording device and the elastically deformable cover member of the apparatus covers a nozzle-defining surface of the recording head such that a space filled with air is formed between the elastically deformable cover member and the nozzle-defining surface, the recording head having at least one nozzle opening in a nozzle-defining surface thereof for ejecting at least one droplet of ink toward a recording medium, the method comprising:

keeping, while the elastically deformable cover member is air-tightly contacted with the recording head and a volume of said space is decreased by elastic deformation of at least a portion of the elastically deformable cover member, a communication between said space and an atmosphere so that substantially no difference is produced between an air pressure in said space and an atmospheric pressure, and shutting off, after the elastically deformable cover member has been air-tightly contacted with the recording head, the communication between said space and the atmosphere, so that said space is air-tightly closed during a time period in which the elastically deformable cover member is kept air-tightly contacted with the recording head.

18. The apparatus according to claim 1, further comprising:

a head holder, which holds the recording head and an ink tank, which stores the ink to be supplied to the at least one nozzle of the recording head.

19. A method of maintaining a recording head which is for use as a portion of a recording device, in a recording-head maintaining state in which the recording head is not attached to a remaining portion of the recording device, the remaining portion including at least a portion of an ink communication passage connected to the recording head during a recording operation, and in which an elastically deformable cover member covers a nozzle-defining surface of the recording head such that a space filled with air is formed between the elastically deformable cover member and the nozzle-defining surface, the recording head having at least one nozzle opening in the nozzle-defining surface thereof for ejecting at least one droplet of ink toward a recording medium, the method comprising:

keeping, while the elastically deformable cover member is air-tightly contacted with the recording head and a volume of said space is decreased by elastic deformation of at least a portion of the elastically deformable cover member, a communication between said space and an atmosphere so that substantially no difference is produced between an air pressure in said space and an atmospheric pressure, and shutting off, after the cover member has been air-tightly contacted with the recording head, the communication between said space and the atmosphere, so that said space is air-tightly closed during a time period in which the elastically deformable cover member is kept air-tightly contacted with the recording head.

20. The method according to claim 19, wherein said keeping comprises:

preparing the cover member which has at least one communication hole through which said space communicates with the atmosphere, and causing, in a state in which said at least one communication hole is open, the cover member to be air-tightly contacted with the recording head to cover the nozzle-defining surface thereof, and wherein said shutting comprises air-tightly closing, with a closing member, said at least one communication hole.

21. The method according to claim 19, wherein said keeping comprises:

preparing the cover member which has at least one communication hole through which said space communicates with the atmosphere, and causing, in a state in which said at least one communication hole is open, the cover member to be air-tightly contacted with the recording head to cover the nozzle-defining surface thereof, and wherein said shutting comprises air-tightly closing, with a packing material, said at least one communication hole.

22. The method according to claim 19, wherein the cover member is formed of an elastic material, wherein said keeping comprises:

penetrating, with at least one tubular member, the cover member to form at least one through-hole and allow said space to communicate with the atmosphere through said at least one tubular member, and causing, in a state in which said space communicates with the atmosphere through said at least one tubular member, the cover member to be air-tightly contacted with the recording head to cover the nozzle-defining surface thereof, and wherein said shutting comprises pulling said at least one tubular member out of the cover member so as to close said at least one through-hole owing to an elastic restoring deformation of the cover member.

23. The method according to claim 19, wherein said keeping comprises steps of:

preparing, at a position separate from the recording device, at least one holding member which holds the cover member, and holding, with said at least one holding member, the recording head such that the cover member is kept in pressed contact with the recording head to cover the nozzle defining surface thereof, in a state in which said space communicates with the atmosphere, and wherein said shutting follows said holding.

24. The method according to claim 23, wherein said preparing comprises first holding the cover member, with a first holding member as one of a plurality of said holding members, and wherein said holding comprises second holding including causing a second holding member, as another of the holding members to engage the first holding member and press the cover member against the recording head.

25. The method according to claim 24, wherein said second holding member further comprises holding the recording head, with the first holding member, such that the cover member held by the first holding member is kept in contact with the recording head to cover the nozzle-defining surface thereof, in the state in which said space communicates with the atmosphere.

26. The method according to claim 24, wherein said second holding member comprises maintaining the recording head in the recording-head maintaining state in which an entirety of the recording head is encapsulated by the first and second holding members.

* * * * *